US011479935B2

(12) United States Patent
White et al.

(10) Patent No.: US 11,479,935 B2
(45) **Date of Patent: *Oct. 25, 2022**

(54) EXTENSIBLE SHELLS AND RELATED METHODS FOR CONSTRUCTING A DUCTILE SUPPORT PIER

(71) Applicant: Geopier Foundation Company, Inc., Davidson, NC (US)

(72) Inventors: David J. White, Davidson, NC (US); Kord J. Wissmann, Davidson, NC (US); Lake Carter, Davidson, NC (US)

(73) Assignee: Geopier Foundation Company, Inc., Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/114,829

(22) Filed: Dec. 8, 2020

(65) Prior Publication Data

US 2021/0087769 A1 Mar. 25, 2021

Related U.S. Application Data

(63) Continuation of application No. 16/715,333, filed on Dec. 16, 2019, now Pat. No. 10,858,796, which is a (Continued)

(51) Int. Cl.
*E02D 3/08* (2006.01)
*E02D 7/28* (2006.01)

(Continued)

(52) U.S. Cl.
CPC ..... *E02D 3/08* (2013.01); *E02D 5/60* (2013.01); *E02D 7/28* (2013.01); *E02D 23/00* (2013.01);

(Continued)

(58) Field of Classification Search
CPC .. E02D 3/08; E02D 7/28; E02D 23/00; E02D 27/18; E02D 27/20; E02D 27/28
See application file for complete search history.

(56) References Cited

U.S. PATENT DOCUMENTS 887,175 A 5/1908 Abbott
1,404,925 A 1/1922 Blumenthal (Continued)

FOREIGN PATENT DOCUMENTS

DE 10310727 A1 10/2004
EP 1234916 A2 8/2002

(Continued)

OTHER PUBLICATIONS

International Search Report and Written Opinion issued in counterpart PCT Application No. PCT/US2018/038048 dated Aug. 9, 2018.

*Primary Examiner* — Frederick L Lagman
(74) *Attorney, Agent, or Firm* — E. Eric Mills; Todd Allen Serbin; Nexsen Pruet, PLLC

(57) ABSTRACT

Extensible shells and related methods for constructing a support pier are disclosed. An extensible shell can define an interior for holding granular construction material and define a first opening at a first end for receiving the granular construction material into the interior and a second opening at a second end. The extensible shell can be flexible such that the shell expands when granular construction material is compacted in the interior of the shell. A method may include positioning the extensible shell in the ground and filling at least a portion of the interior of the shell with the granular construction material. The granular construction material may be compacted in the interior of the extensible shell to form a support pier.

8 Claims, 26 Drawing Sheets

Related U.S. Application Data continuation of application No. PCT/US2018/038048, filed on Jun. 18, 2018, application No. 17/114,829, which is a continuation-in-part of application No. 15/430,807, filed on Feb. 13, 2017, now Pat. No. 10,513,831, which is a continuation of application No. 14/809,579, filed on Jul. 27, 2015, now Pat. No. 9,567,723.

(60) Provisional application No. 62/520,621, filed on Jun. 16, 2017.

(51) Int. Cl.

| | |
|---|---|
| ***E02D 5/60*** | (2006.01) |
| ***E02D 27/18*** | (2006.01) |
| ***E02D 23/00*** | (2006.01) |
| ***E02D 27/20*** | (2006.01) |
| ***E02D 27/16*** | (2006.01) |
| *E02D 7/02* | (2006.01) |
| *E02D 7/30* | (2006.01) |

(52) U.S. Cl.

CPC ..... *E02D 27/16* (2013.01); *E02D 27/18* (2013.01); *E02D 27/20* (2013.01); *E02D 7/02* (2013.01); *E02D 7/30* (2013.01); *E02D 2200/165* (2013.01); *E02D 2200/1685* (2013.01); *E02D 2200/1692* (2013.01); *E02D 2250/0007* (2013.01); *E02D 2300/0006* (2013.01); *E02D 2300/0079* (2013.01)

(56) References Cited

U.S. PATENT DOCUMENTS

| | | | | |
|---|---|---|---|---|
| 1,598,300 | A | 8/1926 | Moran | |
| 1,775,217 | A | 9/1930 | Thornley | |
| 1,794,892 | A | 3/1931 | Goldsborough | |
| 2,555,359 | A * | 6/1951 | Montague | E02D 5/46 405/238 |
| 2,684,576 | A | 7/1954 | Pickman | |
| 2,911,795 | A | 12/1955 | Gobi | |
| 2,779,161 | A | 1/1957 | Pickman | |
| 3,005,315 | A | 7/1958 | Gobi | |
| 3,027,724 | A | 4/1962 | Smith | |
| 3,220,195 | A | 11/1965 | William | |
| 3,316,722 | A | 5/1967 | Gibbons et al. | |
| 3,327,483 | A | 6/1967 | Gibbons | |
| 3,496,729 | A | 2/1970 | Pleuger | |
| 3,751,931 | A | 8/1973 | Merjan | |
| 3,797,259 | A | 3/1974 | Kammerer, Jr. | |
| 4,397,588 | A | 8/1983 | Goughnour | |
| 4,462,716 | A | 7/1984 | Merjan | |
| 4,661,021 | A | 4/1987 | Granstrom et al. | |
| 4,808,038 | A | 2/1989 | Roberts et al. | |
| 4,992,002 | A | 2/1991 | Dewitt | |
| 5,039,256 | A | 8/1991 | Gagliano | |
| 5,152,639 | A | 10/1992 | Roberto | |
| 5,320,453 | A | 6/1994 | Bullivant | |
| 5,419,658 | A | 5/1995 | DeWitt | |
| 5,595,459 | A | 1/1997 | Lomonaco | |
| 5,797,705 | A | 8/1998 | Kellner | |
| 6,042,304 | A | 3/2000 | Manning | |
| 6,318,700 | B1 | 11/2001 | Cliff | |
| 6,354,766 | B1 | 3/2002 | Fox | |
| 6,354,768 | B1 | 3/2002 | Fox | |
| 6,427,402 | B1 | 8/2002 | White | |
| 6,663,322 | B1 | 12/2003 | Listle | |
| 7,004,684 | B2 | 2/2006 | Fox | |
| 7,201,540 | B2 | 4/2007 | Ding | |
| 7,226,246 | B2 | 6/2007 | Fox | |
| 7,326,004 | B2 | 2/2008 | Wissmann et al. | |
| 7,494,299 | B1 | 2/2009 | Whitsett | |
| 7,604,437 | B2 | 10/2009 | Wissmann et al. | |
| 7,963,724 | B2 | 6/2011 | Wissmann et al. | |
| 8,043,028 | B2 | 10/2011 | Wissmann et al. | |
| 8,128,319 | B2 | 3/2012 | Wissmann | |
| 8,152,415 | B2 | 4/2012 | Fox et al. | |
| 8,221,033 | B2 | 7/2012 | White | |
| 8,328,470 | B2 | 12/2012 | Maher et al. | |
| 9,091,036 | B2 | 7/2015 | White | |
| 9,567,723 | B2 | 2/2017 | White | |
| 9,915,050 | B2 * | 3/2018 | Maher | E02D 3/054 |
| 10,513,831 | B2 * | 12/2019 | White | E02D 23/00 |
| 10,858,796 | B2 * | 12/2020 | White | E02D 27/16 |
| 2005/0081459 | A1 | 4/2005 | Moroschan | |
| 2006/0088388 | A1 | 4/2006 | Wissmann | |
| 2007/0077128 | A1 | 4/2007 | Wissmann | |
| 2008/0031694 | A1 | 2/2008 | Wissmann et al. | |
| 2008/0101873 | A1 | 5/2008 | Fox et al. | |
| 2008/0159813 | A1 | 7/2008 | Wissmann et al. | |
| 2008/0205993 | A1 | 8/2008 | Wissmann | |
| 2010/0028087 | A1 | 2/2010 | Wissmann | |
| 2010/0329798 | A1 | 12/2010 | Maher et al. | |
| 2013/0004239 | A1 | 1/2013 | Roberts | |

FOREIGN PATENT DOCUMENTS

| | | | |
|---|---|---|---|
| JP | 62050513 | A | 3/1987 |
| JP | 01226919 | A | 9/1989 |
| JP | 07197442 | A | 8/1995 |

* cited by examiner

EXTENSIBLE SHELLS AND RELATED METHODS FOR CONSTRUCTING A DUCTILE SUPPORT PIER

CROSS-REFERENCE TO RELATED APPLICATIONS

This application is a continuation and claims priority to U.S. patent application Ser. No. 16/715,333 filed Dec. 16, 2019, which is a continuation application of International Application No. PCT/US2018/038048 having an international filing date of Jun. 18, 2018, which is related and claims priority to U.S. Provisional Patent Application No. 62/520,621 filed on Jun. 16, 2017. U.S. patent application Ser. No. 16/715,333 is also a continuation-in-part application of U.S. patent application Ser. No. 15/430,807 filed Feb. 13, 2017 (now U.S. Pat. No. 10,513,831) which is a continuation application of U.S. patent application Ser. No. 14/809,579 filed Jul. 27, 2015 (now U.S. Pat. No. 9,567,723). The entire disclosures of said applications are incorporated herein by reference.

TECHNICAL FIELD

The present invention relates to ground or soil improvement apparatuses and methods. More specifically, the present invention relates to extensible shells and related methods for constructing a ductile support pier.

BACKGROUND ART

Buildings, walls, industrial facilities, and transportation-related structures typically consist of shallow foundations, such as spread footings, or deep foundations, such as driven pilings or drilled shafts. Shallow foundations are much less costly to construct than deep foundations. Thus, deep foundations are generally used only if shallow foundations cannot provide adequate bearing capacity to support building weight with tolerable settlements.

Recently, ground improvement techniques such as jet grouting, soil mixing, stone columns, and aggregate columns have been used to improve soil sufficiently to allow for the use of shallow foundations. Cement-based systems such as grouting or mixing methods can carry heavy loads but remain relatively costly. Stone columns and aggregate columns are generally more cost effective but can be limited by the load bearing capacity of the columns in soft clay soil.

Additionally, it is known in the art to use metal shells for the driving and forming of concrete piles. One set of examples includes U.S. Pat. Nos. 3,316,722 and 3,327,483 to Gibbons, which disclose the driving of a tapered, tubular metal shell into the ground and subsequent filling of the shell with concrete in order to form a pile. Another example is U.S. Pat. No. 3,027,724 to Smith which discloses the installation of shells in the earth for subsequent filling with concrete for the forming of a concrete pile. A disadvantage of these prior art shells is that their sole purpose is for providing a temporary form for the insertion of cementitious material for the forming of a hardened pile for structural load support. The prior art shells are not extensible and thus do not exhibit properties that allow them to engage the surrounding soil through lateral deformations. Further, because they relate to the use of ferrous materials, which are subject to corrosion, their function is complete once the concrete infill hardens. Thus, the prior art shells are not suitable for containing less expensive granular infill materials such as sand or aggregate, because the prior art shells cannot laterally contain the inserted materials during the life of the pier. The prior art shells are also not permeable and are thus ill-suited to drain cohesive soils.

Accordingly, it is desirable to provide improved techniques for constructing a shallow support pier in soil or the ground using extensible shells formed of relatively permanent material of a substantially non-corrosive or non-degradable nature for the containment of compacted aggregate therein.

It is further desirable to provide an embodiment and techniques for constructing a ductile support pier in soil or the ground wherein the pier can deform elasto-plastically without rupture.

BRIEF DESCRIPTION OF THE INVENTION

Extensible shells and related methods for constructing a support pier in ground are disclosed. An extensible shell may define an interior for holding granular construction material and may define an opening for receiving the granular construction material into the interior. The shell may be flexible such that the shell expands laterally outward when granular construction material is compacted in the interior of the shell.

According to one aspect, the shell may include a first end that defines the opening. The shell may be shaped to taper downward from the first end to an opposing second end of the shell.

According to another aspect, the second end of the shell may define a substantially flat, blunt surface.

According to yet another aspect, a cross-section of the shell may form one of a substantially hexagonal shape and a substantially octagonal shape along a length of the shell extending between the first and second ends.

According to a further aspect, a cross-section of the first end of the shell is sized larger than a cross-section of the second end.

According to a still further aspect, the shell is comprised of plastic.

According to another aspect, the shell may define a plurality of apertures extending between an interior of the shell to an exterior of the shell.

According to yet another aspect, the shell may be either substantially cylindrical in shape or substantially conical in shape.

According to an additional aspect, a method may include positioning the shell in the ground and filling at least a portion of the interior of the shell with the granular construction material. The granular construction material may be compacted in the interior of the shell to form a pier.

According to another aspect, a method may include forming a cavity in the ground. The cavity may be partially backfilled with aggregate construction material. Next, the shell may be positioned with the cavity and at least a portion of the interior of the shell filled with granular construction material. The granular construction material may then be compacted in the interior of the shell to form a pier. The compaction may be performed with a primary mandrel. Additional compacting may be performed with a second mandrel that has a larger cross-sectional area than the primary mandrel.

According to a further aspect, the extensible shell may comprise a plurality of slots extending between an interior of the shell to an exterior of the shell, the slots being generally transverse to a centerline along the length of the shell. The slots may be discontinuous around a circumference of the shell thereby maintaining portions of continuous material connectivity along the length of the shell. The slots may have a width in the range of ¼ inch (6.35 mm) to ⅜ inch (9.53 mm) and may be spaced at a distance of 6 inches (152 mm) from one another.

According to a still further aspect, the disclosure is directed to an extensible shell for constructing a support pier in ground, the extensible shell defining an interior for holding granular construction material and said extensible shell defining a first end having a first opening for receiving granular construction material into the interior and a second end having a second opening, wherein the shell is flexible such that the shell expands laterally outward when granular construction material is compacted in the interior of the shell.

In another aspect, the first end defines the first opening with the shell shaped to taper from the first end to opposing second end of the shell, with the second end comprising a second opening.

In yet another aspect, a method for constructing a support pier in ground is disclosed, the method comprising: positioning an extensible shell into ground, the shell defining an interior for holding granular construction material and defining a first opening at a first end for receiving granular construction material into the interior and a second opening at a second end, wherein the shell is flexible such that the shell expands laterally outward when granular construction material is compacted in the interior of the shell; filling at least a portion of the interior of the shell with granular construction material; and compacting the granular construction material in the interior of the shell to form a support pier.

In a further aspect, the disclosure is directed to a method for constructing a support pier in ground, with the method comprising: forming a cavity in the ground; partially backfilling the cavity with an aggregate construction material; positioning an extensible shell into the cavity, with the shell having a first end with a first opening and a second end having a second opening, with the shell defining an interior for holding granular construction material and defining an opening for receiving the granular construction material into the interior, wherein the shell is flexible such that the shell expands when granular construction material is compacted in the interior of the shell; filling at least a portion of the interior of the shell with the granular construction material; and compacting the granular construction material in the interior of the shell to form a support pier.

This brief description is provided to introduce a selection of concepts in a simplified form that are further described below in the detailed description of the invention. This brief description of the invention is not intended to identify key features or essential features of the claimed subject matter, nor is it intended to be used to limit the scope of the claimed subject matter. Further, the claimed subject matter is not limited to implementations that solve any or all disadvantages noted in any part of this disclosure.

DETAILED DESCRIPTION OF THE INVENTION

The present invention is directed to an extensible shell and related methods for constructing a support "shell pier" in ground. Particularly, an extensible shell in accordance with embodiments of the present invention can have an interior into which granular construction material can be loaded and compacted. The shell can be positioned in a cavity formed in the ground (the cavity being formed through a variety of methods as described in more detail below, including driving the shell from grade to form the cavity). After positioning in the ground, granular construction material can be loaded into the interior through an opening of the shell. The granular construction material may be subsequently compacted. The shell can be extensible (or flexible) such that walls of the shell expand when the granular construction material is compacted in the interior of the shell. Therefore, since the shell maintains the compacted granular construction material in a contained manner (i.e., the material cannot expand laterally beyond the shell walls into the in-situ soil) the ground surrounding the shell is reinforced and improved for supporting shallow foundations and other structures. The present invention can be advantageous, for example, because it allows for much higher load carrying capacity due to its ability to limit the granular construction material from bulging laterally outward during loading. The shell is typically made of relatively permanent, substantially non-corrosive and/or non-degradable material such that the lateral bulging of the material is limited for the life of the pier.

Figure 1A:
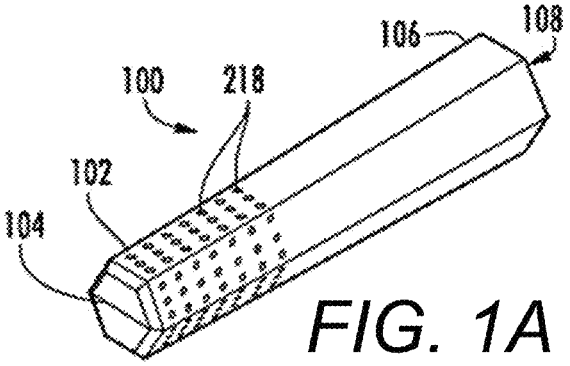
FIG. 1A, FIG. 1B, FIG. 1C, FIG. 1D, and FIG. 1E illustrate different views of an extensible shell in accordance with embodiments of the present invention.

FIGS. 1A-1E illustrate different views of an extensible shell 100 in accordance with embodiments of the present invention. FIG. 1A depicts a perspective view of the extensible shell 100, which includes an enclosed end 102. The surface of the enclosed end 102 can define a substantially flat, blunt bottom surface 104, which can be hexagonal in shape. In the alternative, the enclosed end 102 may have any other suitable shape or size. Further, the bottom of the shell may be open, or may be blunt as in the case of a cylindrical shell, may be pointed as the bottom of a conical shell, or may be truncated to form a blunt shape at the bottom of conical or articulated section such as, for example, a frustum, or frustoconical configuration. It is therefore understood, for the purposes of this disclosure, that the term conical includes frustoconical configurations. The length of the shell may range from about 0.5 m to about 20 m long; such as from about 1 m to about 10 m long. The surfaces of the shell (inside and/or outside) may be smooth or contain a varying degree of roughness for interaction with surrounding surfaces.

Opposing the enclosed end 102 is another end, open end 106, which defines an opening 108 for receiving granular construction material into an interior (not shown in FIG. 1A) defined by the shell 100. As will be described in further detail herein below, the open end 106 is positioned substantial vertical to and above from the enclosed end 102 during construction of the pier.

Figure 1B:
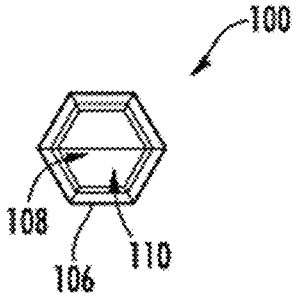

FIGS. 1B, 1C, 1D, and 1E depict a top view, bottom view, a side view, and a cross-sectional side view of the extensible shell 100, respectively. As shown in FIG. 1B, the extensible shell 100 defines a substantially hollow interior 110 extending between the open end 106 (with opening 108) and the enclosed end 102.

Figure 1C:
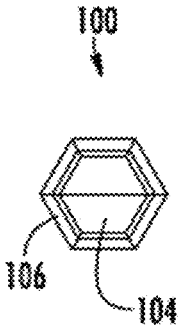
Figure 1D:
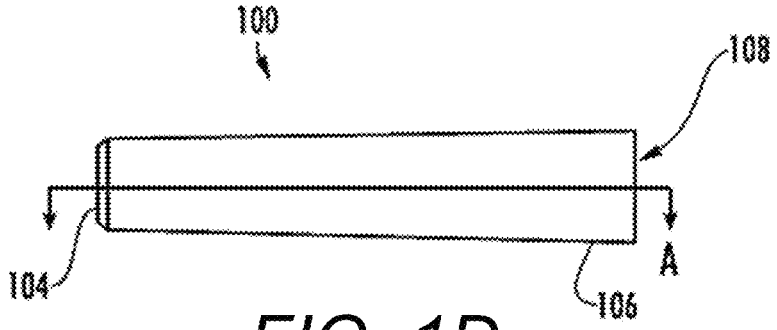
Figure 1E:
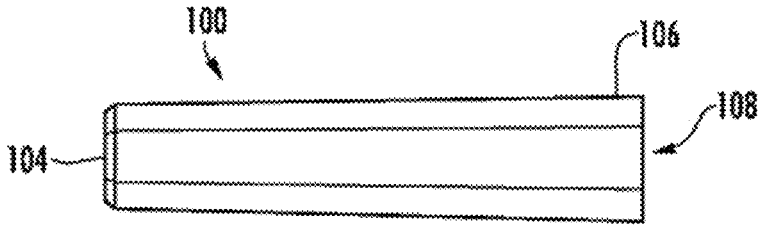

FIG. 1C shows that a cross-section of the open end 106 may be sized larger than the bottom surface 104 of the enclosed end 102. FIG. 1D shows section line A-A arrows indicating the direction of the cross-sectional side view of the extensible shell 100 depicted in FIG. 1E.

The shape of the exterior of the shell 100 may be articulated to form a plurality of panels that form a hexagonal shape in cross-section as viewed from the top or bottom of the shell. Alternatively, the shape may be octagonal, cylindrical, conical, or any other suitable shape.

The extensible shell 100 is often shaped to taper downward from the open end 106 to the enclosed end 102. In one embodiment, the shell 100 tapers at a 2 degree angle, although the shell may taper at any other suitable angle.

The extensible shell 100 may be made of plastic, aluminum, or any metallic or non-metallic material of suitable extensibility, and preferably substantially non-corrosive and/or non-degradable material. The shell 100 may be relatively thin-walled. The thickness of the wall of the shell 100 may range, for example, from about 0.5 mm to about 100 mm. The example shell 100 of FIG. 1B has a thickness of about 0.25 inches (approximately 6.35 mm), although the shell may have any other suitable thickness. This thickness distance is the distance that uniformly separates the interior 110 and the exterior of the shell. The material of the shell and its thickness may be configured such that the shell has suitable integrity to hold construction material in its interior 110 and to expand laterally at least some distance when the construction material is compacted in the interior 110.

Figure 2A:
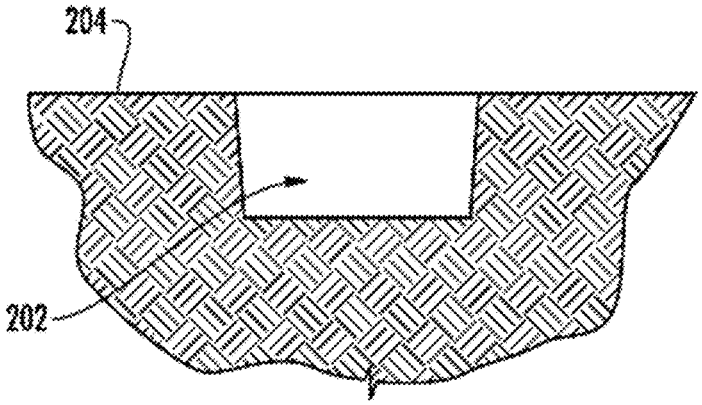
FIG. 2A, FIG. 2B, and FIG. 2C illustrate steps in an exemplary method of constructing a pier in ground using an extensible shell in accordance with an embodiment of the present invention.
Figure 2B:
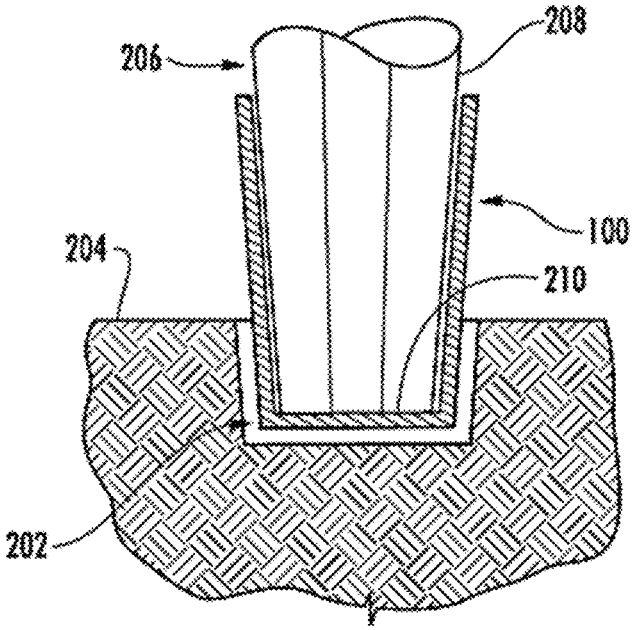
Figure 2C:
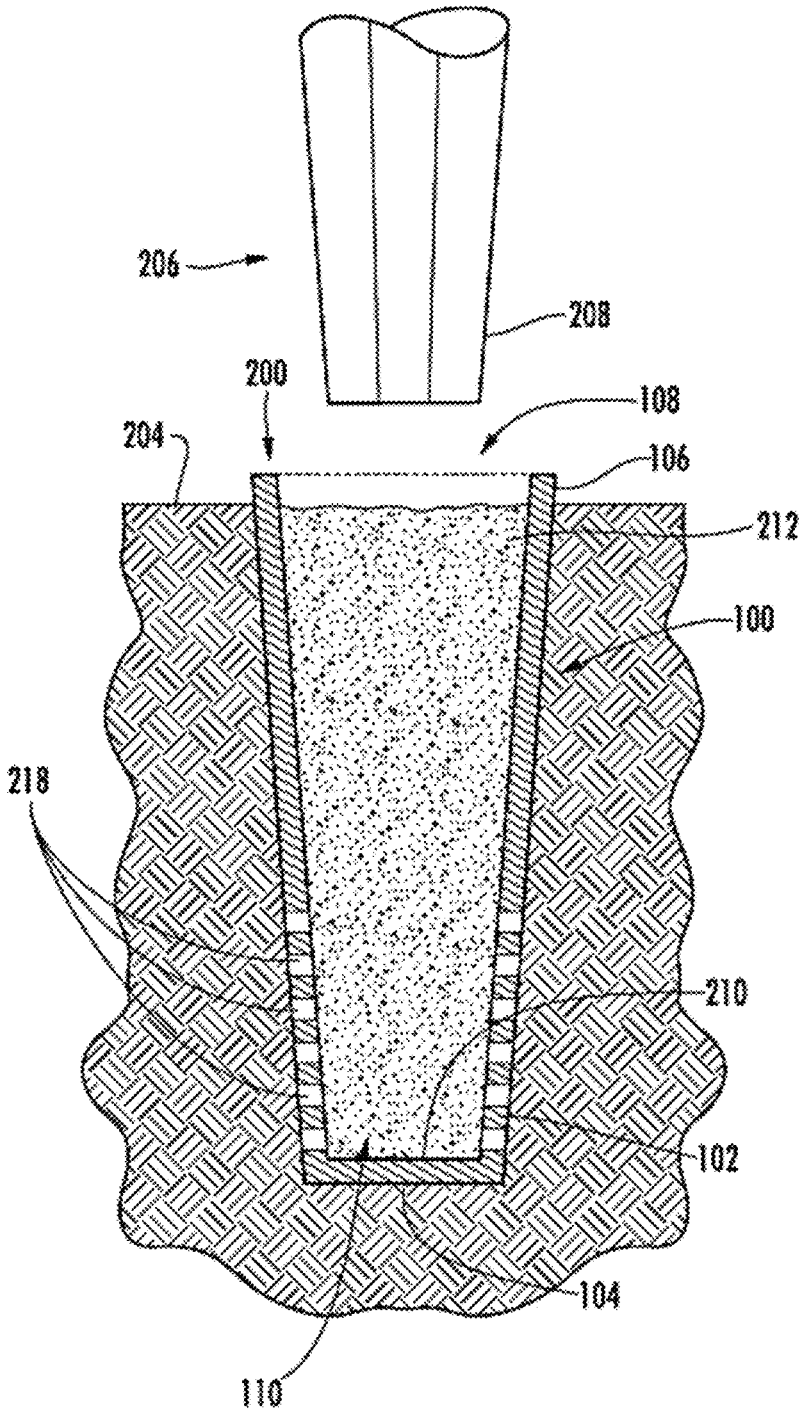

FIGS. 2A-2C illustrate steps in an exemplary method of constructing a pier in ground using an extensible shell 100 in accordance with an embodiment of the present invention. In this example, side partial cross-section views illustrate the use of the extensible shell 100 for constructing a pier 200 in the ground (see FIG. 2C) in accordance with an embodiment of the present invention. Other methods are described with reference to FIGS. 3A-3D and the Examples below. The method of FIGS. 2A-2C includes forming a pre-formed elongate vertical cavity 202 or hole in a ground surface 204, as shown in FIG. 2A. The ground may be comprised of primarily soft cohesive soil such as soft clay and silt, or also loose sand, fill materials, or the like. The cavity 202 may be formed with a suitable drilling device having, for example, a drill head or auger for forming a cavity or hole, or may be formed by other methods for forming a cavity such as by inserting and removing a driving mandrel to the desired pre-formed cavity depth. In some embodiments, the cavity may not be formed at all prior to shell insertion, such as described below with reference to FIGS. 3A-3D.

After the partial cavity 202 has been formed, the extensible shell 100 may be positioned within the cavity 202, as shown in FIG. 2B, for ultimate driving to the desired depth. Particularly, an extractable mandrel 206 may be used for driving the extensible shell 100 into the cavity 202 and ground 204. A tamper head 208 of the mandrel 206 may be positioned against a bottom surface 210 of the interior 110 and used to drive the shell 100 to the desired penetration depth, as shown in FIG. 2C. The cavity 202 is at that point formed of a size and dimension such that the exterior surface of the extensible shell 100 fits tightly against the walls of the cavity 202.

After the extensible shell 100 has been driven into (while forming) the fully enlarged cavity 202, the mandrel 206 is removed, leaving behind the shell 100 in the cavity 202 and with the interior 110 being empty. The shell 100 may then be filled with a granular construction material 212, such as sand, aggregate, admixture-stabilized sand or aggregate, recycled materials, crushed glass, or other suitable materials as shown in FIG. 2C. The granular construction material 212 may be compacted within the shell using the mandrel 206. The compaction increases the strength and stiffness of the internal granular construction material 212 and pushes the granular construction material 212 outward against the walls of the shell 100, which pre-strains the shell 100 and increases the coupling of the shell 100 with the in-situ soil. Significant increases in the load carrying capacity of the pier 200 can be achieved as a result of the restraint offered by the shell 100.

Figure 3A:
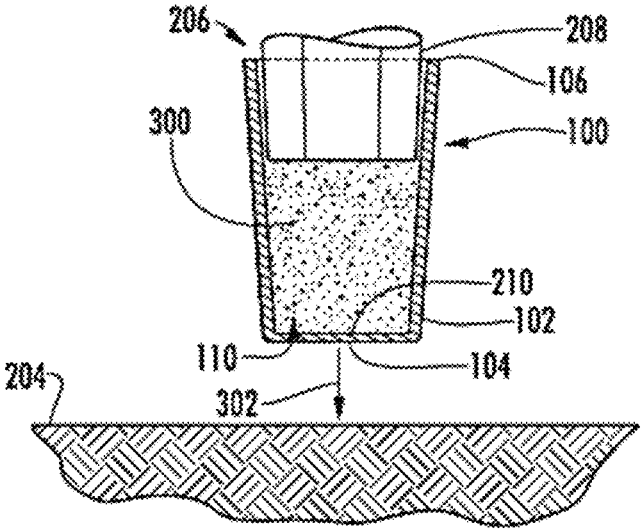
FIG. 3A, FIG. 3B, FIG. 3C, and FIG. 3D illustrate steps in another exemplary method of constructing a support pier in ground using an extensible shell in accordance with embodiments of the present invention.

FIGS. 3A-3D illustrate steps in another exemplary method of constructing a pier in ground using an extensible shell in accordance with an embodiment of the present invention. Referring to FIG. 3A, an aggregate construction material 300 (e.g., sand) is placed in the interior 110 of the shell 100 to a predetermined level above the bottom surface 210 of the shell 100. Next, the tamper head 208 of the extractable mandrel 206 is fitted to the interior 110 of the extensible shell 100, and against the top of the aggregate construction material 300. The mandrel 206 may then be moved towards the ground 204 in a direction indicated by arrow 302 for driving the shell 100 into the ground 204. Driving may be facilitated using a small pre-formed cavity (e.g., the cavity 202 shown in FIG. 2A), or not, depending on site conditions.

Figure 3B:
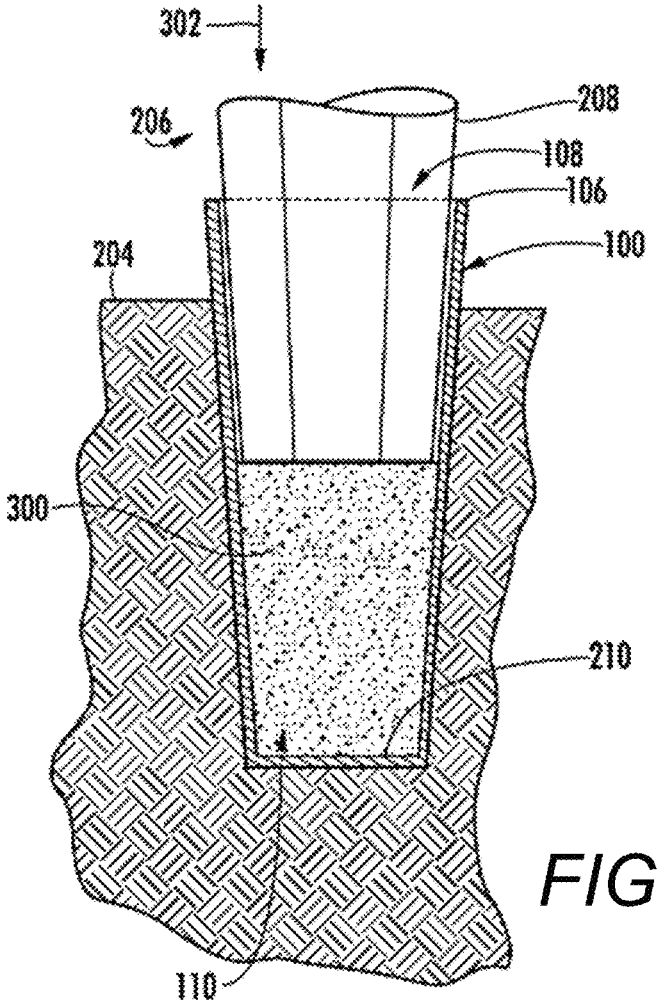
Figure 3C:
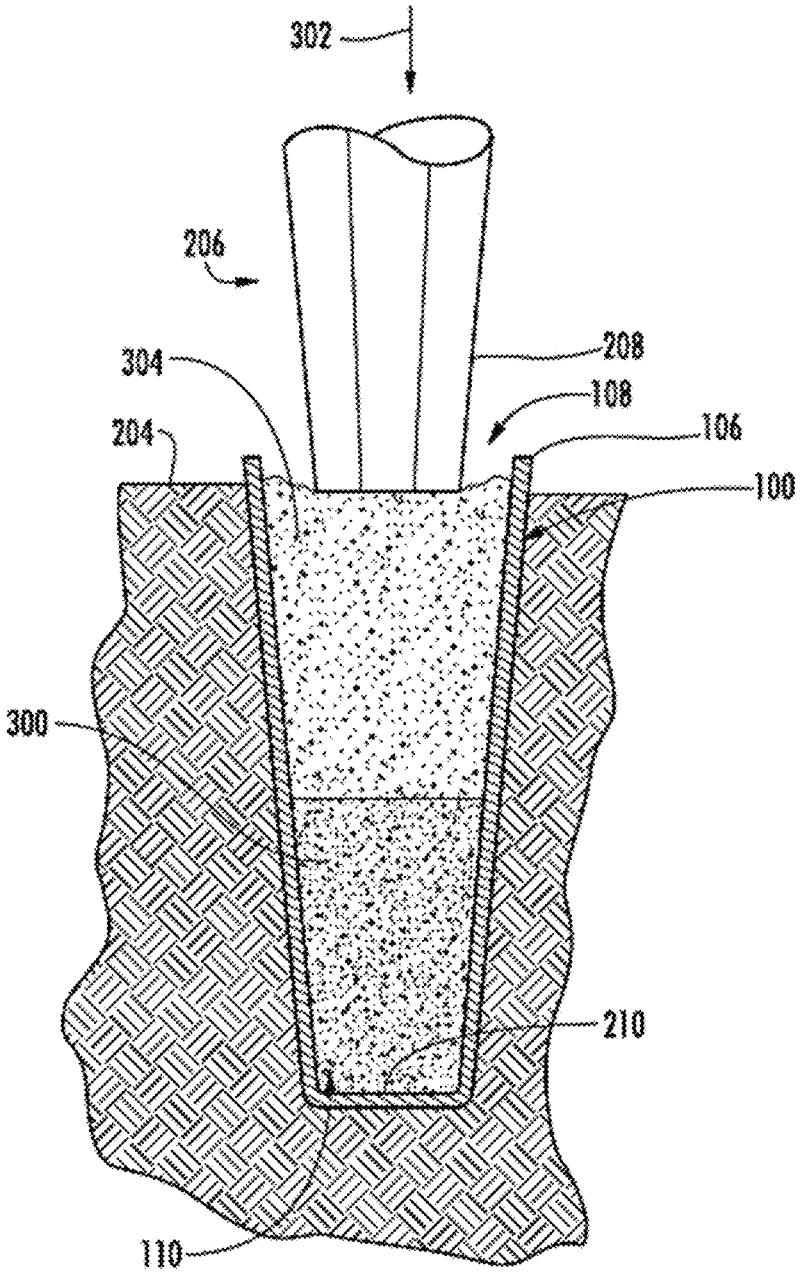

Referring to FIG. 3B, the mandrel 206 is shown driving the shell 100 into the ground 204 in the direction 302 such that the shell 100 is at a predetermined depth below grade. Next, the mandrel 206 may be removed. At FIG. 3C, the shell 100 is substantially filled with additional aggregate construction material 304 (e.g., sand) through opening 108, and the mandrel 206 is positioned as shown. Next, vertical compaction force and/or vibratory energy is applied to the mandrel 206 for compacting the materials 300 and 304. The shell 100 may be driven by this force to a further depth below grade. The addition of construction material 304 and subsequent compaction can be repeated several times until the final pier is constructed. Alternatively, the shell may be "topped off" with additional construction material after only one compaction cycle.

Figure 3D:
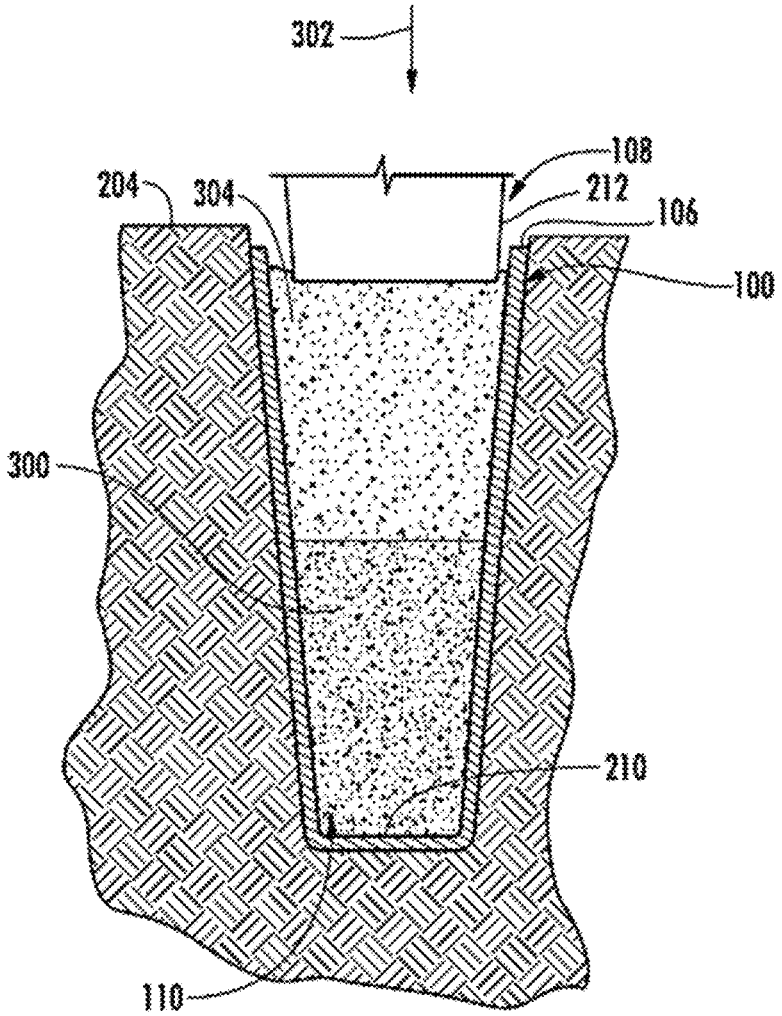

In an embodiment of the present invention, a second mandrel 212 may be used to compact the upper portion of the material 304 in the direction 302, as shown in FIG. 3D. The second mandrel 212 may have a larger cross-sectional area than the primary mandrel 206 to provide increased confinement during compaction.

In an embodiment of the present invention, the shell 100 may define apertures 218 that extend between the interior 110 and an exterior of the shell 100 to the in-situ soil (see FIGS. 1A and 2C). The apertures 218 may provide for drainage of excess pore water pressure that may exist in the in-situ soil to drain into the interior 110 of the shell 100. Increases in pore water pressure typically decreases the strength of the soil and is one of the reasons that prior art piers are limited in their load carrying capacity in saturated cohesive soil such as clay, silt, or the like. The apertures 218 envisioned herein allow the excess pore water pressure in the soil to dissipate into the pier 200 after insertion. This allows the in-situ soil to quickly gain strength with time, a phenomena not enjoyed by concrete, steel piles, or grout elements (i.e., "hardened" elements). The drainage of excess pore water pressures allows additional settlement of the soil that may occur as a result of pore water pressure dissipation prior to the application of foundation loads.

Other embodiments may not define apertures, or may provide one or more apertures 218 on only one side of the shell 100. Alternatively, the apertures 218 may be defined in the shell 100 such that they are positioned along a portion of the length of the shell 100, are positioned along the full length of the shell 100, or may be positioned asymmetrically in various configurations. The sizes and placements of the apertures 218 can vary according to the size of the shell 100, the conditions of the ground (e.g., where higher water pressure is known to exist), and other relevant factors. The apertures 218 may range in size from about 0.5 mm to about 50 mm; such as from about 1 mm to about 25 mm. In another embodiment, the top of the shell 100 may be enclosed and connected to vacuum pressure to further increase and accelerate drainage of excess water pressure in the surrounding soil through the apertures 218.

The mandrel 206 may be constructed of sufficient strength, stiffness, and geometry to adequately support the shell 100 during driving and to be able to be retracted from the shell 100 after driving. In one embodiment, the shape of the exterior of mandrel 206 is substantially similar to the shape of the interior 110 defined by the shell 100. In another embodiment, the mandrel 206 is comprised primarily of steel. Other materials are also envisioned including, but not limited to, aluminum, hard composite materials, and the like.

The mandrel 206 may be driven by a piling machine or other suitable equipment and technique that may apply static crowd pressure, hammering, or vibration sufficient to drive the mandrel 206 and extensible shell 100 into the surface of ground 204. In one embodiment, the machine may be comprised of an articulating, diesel, pile-driving hammer that drives the mandrel 206 using high energy impact forces. The hammer may be mounted on leads suspended from a crane. In another embodiment, the hammer may be a sheet pile vibrator mounted on a rig capable of supplying a downward static force. In another embodiment, the shell 100 may be placed in a pre-formed cavity 200 and constructed without the use of an extractable mandrel. Standard methods of driving mandrels into the ground are known in the art and therefore, can be used for driving.

The following Examples illustrate further aspects of the invention.

Example I

As an example, piers were constructed using extensible shells in accordance with embodiments of the present invention at a test site in Iowa. Load tests were conducted on the piers using a conventional process. The extensible shells used in the tests and the methods of their use consisted essentially of that described above and shown in the attached Figures. In this test, extensible shells formed from LEXAN® polycarbonate plastic were installed at a test site characterized by soft clay soil. This testing was designed to compare the load versus deflection characteristics of an extensible shell in accordance with the present invention to aggregate piers constructed using a driven tapered pipe. Two comparison aggregate piers (of fine and coarse aggregate) were constructed to a depth of 12 feet below the ground surface.

In this test, the extensible shell was formed by bending sheets of the plastic to form a tapered shape having a hexagonal cross-section and that tapered downward from an outside diameter of 24 inches (610 mm) at the top of the shell to a diameter of 18 inches (460 mm) at the bottom of the shell. A panel of the shells overlapped, and this portion was both glued and bolted together. The length of the extensible shell was 9.5 feet (2.9 m). In this embodiment, apertures were formed in the extensible shell by perforating the sides of the shell with 3 mm to 7 mm diameter "weep" holes spaced apart from each another. The bottom portion of the shell was capped with a steel shoe to facilitate driving. LEXAN® polycarbonate plastic has a tensile strength of approximately 16 MPa (2300 psi) at 11 percent elongation and a Young's modulus of 540 MPa (78,000 psi). The extractable mandrel used in this test was attached to a high frequency hammer, which is often associated with driving sheet piles. The hammer is capable of providing both downward force and vibratory energy for driving the shell into the ground and for compacting aggregate construction material in the shell.

In this example, the extensible shell was driven into the ground without pre-drilling of the cavity or hole. Particularly, in this test, the two shells were installed by orientating each shell in a vertical direction, placing approximately 4 feet (1.2 m) of sand at the base of the shell, and then driving the shell into the ground surface with an extractable mandrel with exterior dimensions similar to those of the interior of the shell. The shell was driven to a depth of approximately 8.5 feet (2.6 m) below grade. The mandrel was removed and the shells were filled with sand. The extractable mandrel was then re-lowered within the shells and vertical compaction force in combination with vibratory energy was applied to both compact the sand to drive the shell to a depth of 9 feet (2.7 m) below grade. The mandrel was then extracted and the upper portion of the shell was then filled with crushed stone to a depth of 0.5 feet (0.2 m) below grade. A concrete cap was then poured above the crushed stone fill to facilitate load testing.

Radial cracks were observed to extend outward from the edge of the shell pier. These cracks form drainage galleries that are the result of high radial stresses and low tangential stresses created in the ground during pier installation. Drainage was afforded by the perforations in the shell and allowed soil water to drain into the sand and aggregate filled piers.

Figure 4:
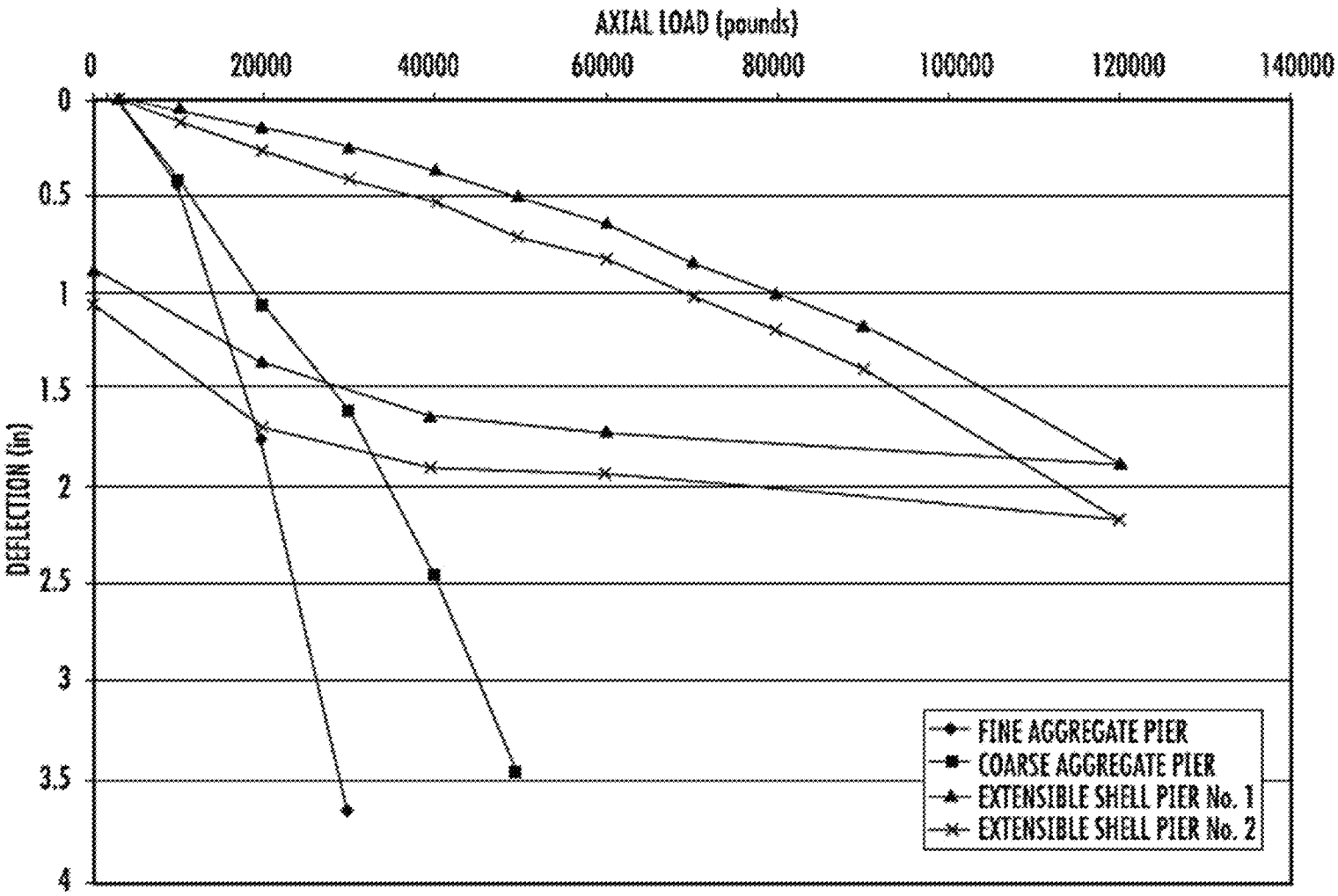
FIG. 4, FIG. 5, FIG. 6, and FIG. 7 are graphs showing results of load tests of support piers constructed using an extensible shell in accordance with embodiments of the present invention.

The shell piers were load tested using a hydraulic jack pushing against a test frame. FIG. 4 is a graph showing results of the load test compared with aggregate piers constructed using a similarly shaped mandrel. As shown in FIG. 4, at a top of pier deflection of one inch, the piers constructed without shells supported a load of 15,000 pounds to 20,000 pounds (67 kN to 89 kN). The shell piers constructed in this embodiment of the invention supported a load of 310 kN to 360 kN (70,000 to 80,000 pounds) at a top of pier deflection of one inch. The load carrying capacity of the shell piers constructed in accordance with the present invention provided a 3.5 to 5.3 fold improvement when compared to aggregate piers constructed without extensible shells.

Example II

In other testing, extensible shells were formed from high-density polyethylene polymer ("HDPE") and installed at the test site as described in Example I. This testing program was designed to compare the load versus deflection characteristics of this embodiment of the present invention to aggregate piers constructed using a driven tapered pipe as described in Example I. A total of six shell piers were installed as part of this example.

In this test, the extensible shell was formed by a rotomolding process. The shells defined a tapered shape having a hexagonal cross-section and that tapered downward from an outside diameter of 585 mm (23 inches) at the top of the shell to a diameter of 460 mm (18 inches) at the bottom of the shell. The bottom of the extensible shell was integrally constructed as part of the shell walls as a result of the rotomolding process. The mandrel in this embodiment was attached to the same hammer as described in Example I.

The installation process in this Example was somewhat different from that in Example I and included pre-drilling a 30 inch (0.76 m) diameter cavity to a depth of 2 feet (0.61 m) to 3 feet (0.9 m) below the ground surface (rather than driving the shell initially from top grade). The shell was then placed vertically in the pre-drilled cavity. The extractable mandrel was then inserted into the shell, and the shell was driven to a depth 11 feet (3.4 m) to 12 feet (3.7 m) below grade. The extensible shell was then filled with aggregate construction material and compacted in four lifts; with each lift about 7.4 cubic feet (0.2 cubic meters) in volume. The aggregate consisted of sand in five of the piers and consisted of crushed stone in one of the piers. Each lift was compacted with the downward pressure and vibratory energy of the extractable mandrel.

After placement and compaction of sand within the extensible shells, the top of the shells were situated at about 2 feet (0.61 m) to 3 feet (0.9 m) below the ground surface. Crushed stone was then placed and compacted above the extensible shell to a depth of 1 foot (0.3 m) below the ground surface. A concrete cap was then poured above the crushed stone fill to facilitate load testing.

Figure 5:
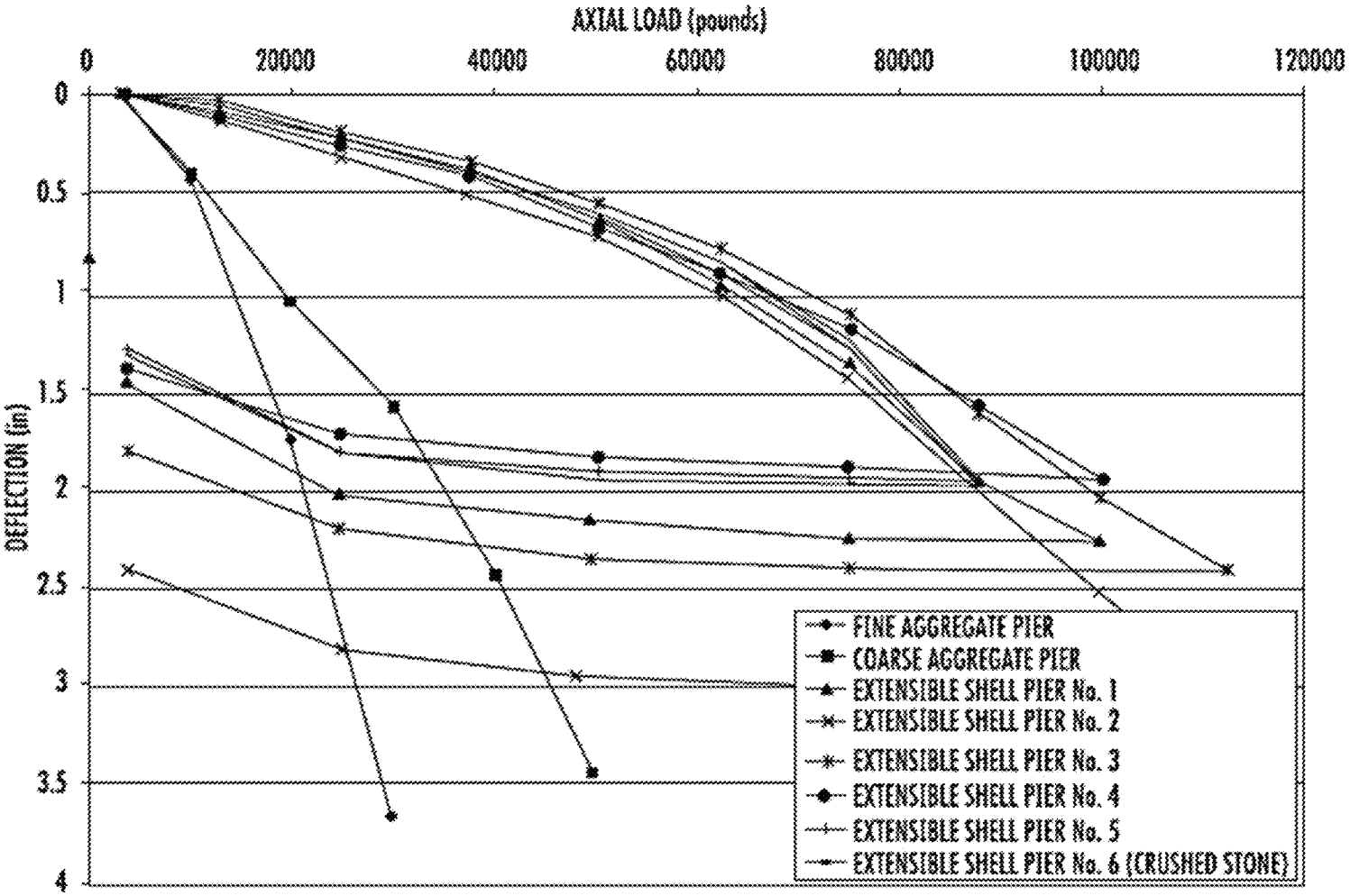

The shell piers were load tested using a hydraulic jack pushing against a test frame. FIG. 5 is a graph showing results of the load test compared with the aggregate piers described in Example I. As shown in FIG. 5, at a top of pier deflection of one inch, the piers constructed without shells supported a load of 15,000 pounds to 20,000 pounds (67 kN to 89 kN). The shell piers constructed in this embodiment of the invention supported loads ranging from 62,000 pounds (275 kN) to 71,000 pounds (315 kN) at the top of pier deflections of one inch. The load carrying capacity of the shell piers constructed in accordance with this embodiment of the present invention provided a 3.1 to 4.7 fold improvement when compared to aggregate piers constructed without extensible shells.

Example III

In another test, an extensible shell of the same embodiment described in Example II was installed at the test site as described in Example I. This testing program was designed to compare the load versus deflection characteristics of this embodiment of the invention to aggregate piers constructed using a driven tapered pipe as described in Example I. The mandrel, hammer, and extensible shell used for testing were the same as used in Example II.

In this embodiment of the present invention, the installation process included pre-drilling a 30 inch (0.76 m) diameter cavity to a depth of 3 feet (0.9 m) below the ground surface. The extractable mandrel was then inserted into the pre-drilled cavity, to create a cavity with a total depth of 5 feet (1.5 m) below the ground surface. This cavity was then backfilled to the ground surface with sand. The extensible shell was then driven vertically through the sand filled cavity with the extractable mandrel to a depth of 9 feet (2.7 m) below the ground surface, so that the top of the shell was situated 6 inches above the ground surface. The extensible shell was then filled with sand in four lifts, with each lift about 7.4 cubic feet (0.2 cubic meters) in volume. Each lift was compacted with the downward pressure and vibratory energy of the mandrel. A concrete cap encompassing the top of the shell was then cast over the shell to facilitate load testing.

Figure 6:
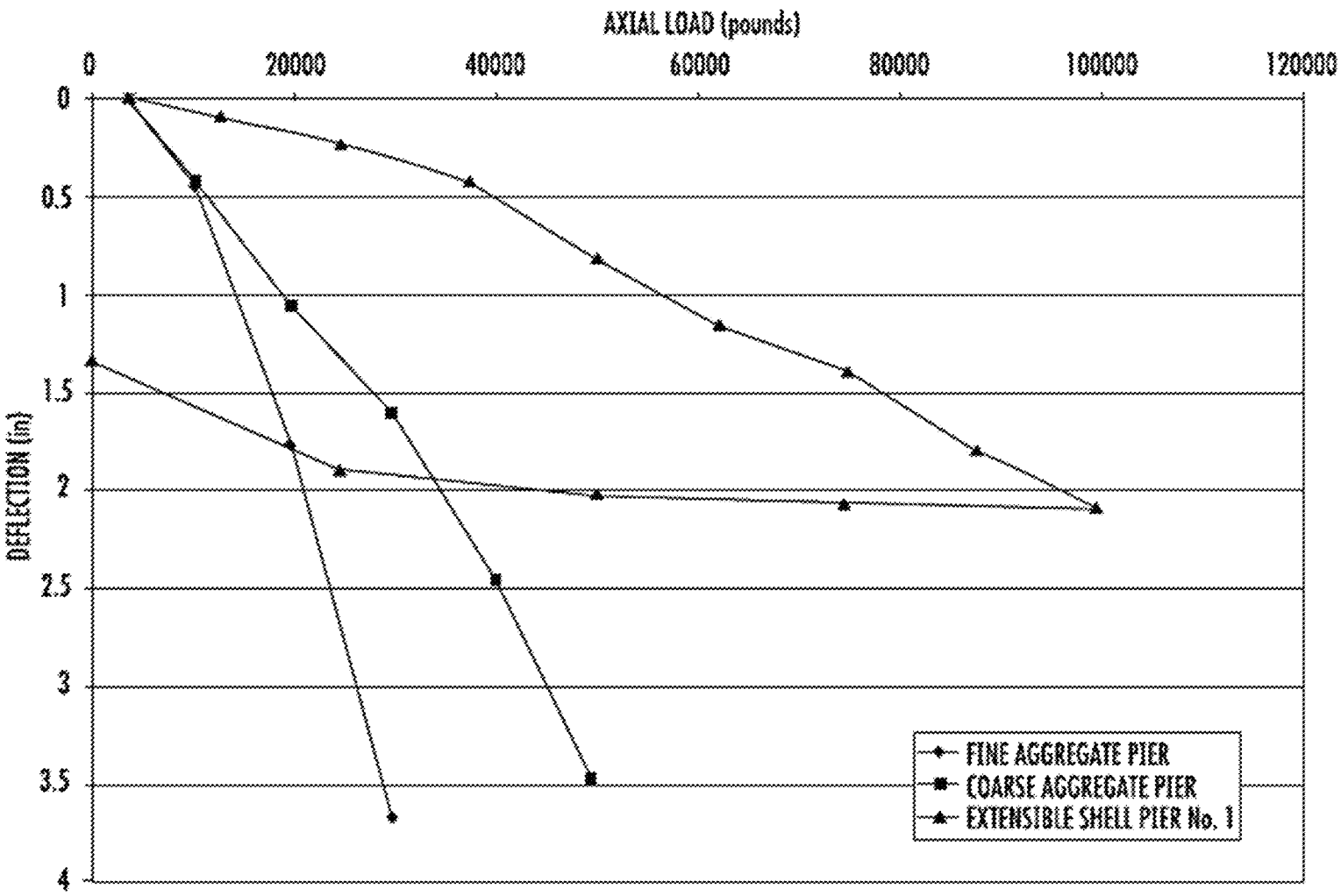

The shell pier was load tested using a hydraulic jack pushing against a test frame. FIG. 6 is a graph showing results of the load test compared with the aggregate piers described in Example I. As shown in FIG. 6, at a top of pier deflection of one inch, the piers constructed without shells supported a load of 15,000 pounds to 20,000 pounds (67 kN to 89 kN). The pier constructed in this embodiment of the present invention supported a load of 57,500 pounds (255 kN) with a top of pier deflection of one inch. The load carrying capacity of the shell pier constructed in accordance with this embodiment of the present invention provided a 2.9 to 3.8 fold improvement when compared to aggregate piers constructed without extensible shells.

Example IV

In yet another test, an embodiment of the present invention was installed at a project site characterized by 3 feet (0.9 m) of loose sand soil over 7 feet (2.1 m) of soft clay soil over dense sand soil. The embodiment of the present invention at the project site was used to support structural loads, such as those associated with building foundations and heavily loaded floor slabs. The mandrel, hammer, and extensible shell used for testing were the same as used in Examples II and III.

In this embodiment of the present invention, the installation process included pre-drilling a 30 inch (0.76 m) diameter pre-drill to a depth of 3 feet (0.9 m) below the ground surface. Approximately 7.4 cubic feet (0.2 cubic meters) of sand was then placed in the pre-drilled cavity. This resulted in the pre-drilled cavity being about half-full.

The extensible shell was then placed vertically in the partially backfilled pre-drilled cavity. The extractable mandrel was then inserted into the shell, and the shell was driven to a depth 12.5 feet (3.8 m) below grade. The extensible shell was then filled with sand in four lifts; with each lift about 7.4 cubic feet (0.2 cubic meters) in volume. Each lift was compacted with the downward pressure and vibratory energy of the mandrel.

After placement and compaction of sand within the extensible shell, a lift of crushed stone about 4.9 cubic feet (0.14 cubic meters) in volume was placed and compacted within the extensible shell. Crushed stone was then placed and compacted above the extensible shell until the crushed stone backfill was level with the ground surface.

At one shell location, a 30 inch (0.76 m) diameter concrete cap was placed over the shell to facilitate load testing. At a second shell location, a 6 foot (1.8 m) wide by 6 foot (1.8 m) wide concrete cap was placed over the shell to facilitate loading and to measure the load deflection characteristics of the composite of native matrix soil and extensible shell (to simulate a floor slab).

Figure 7:
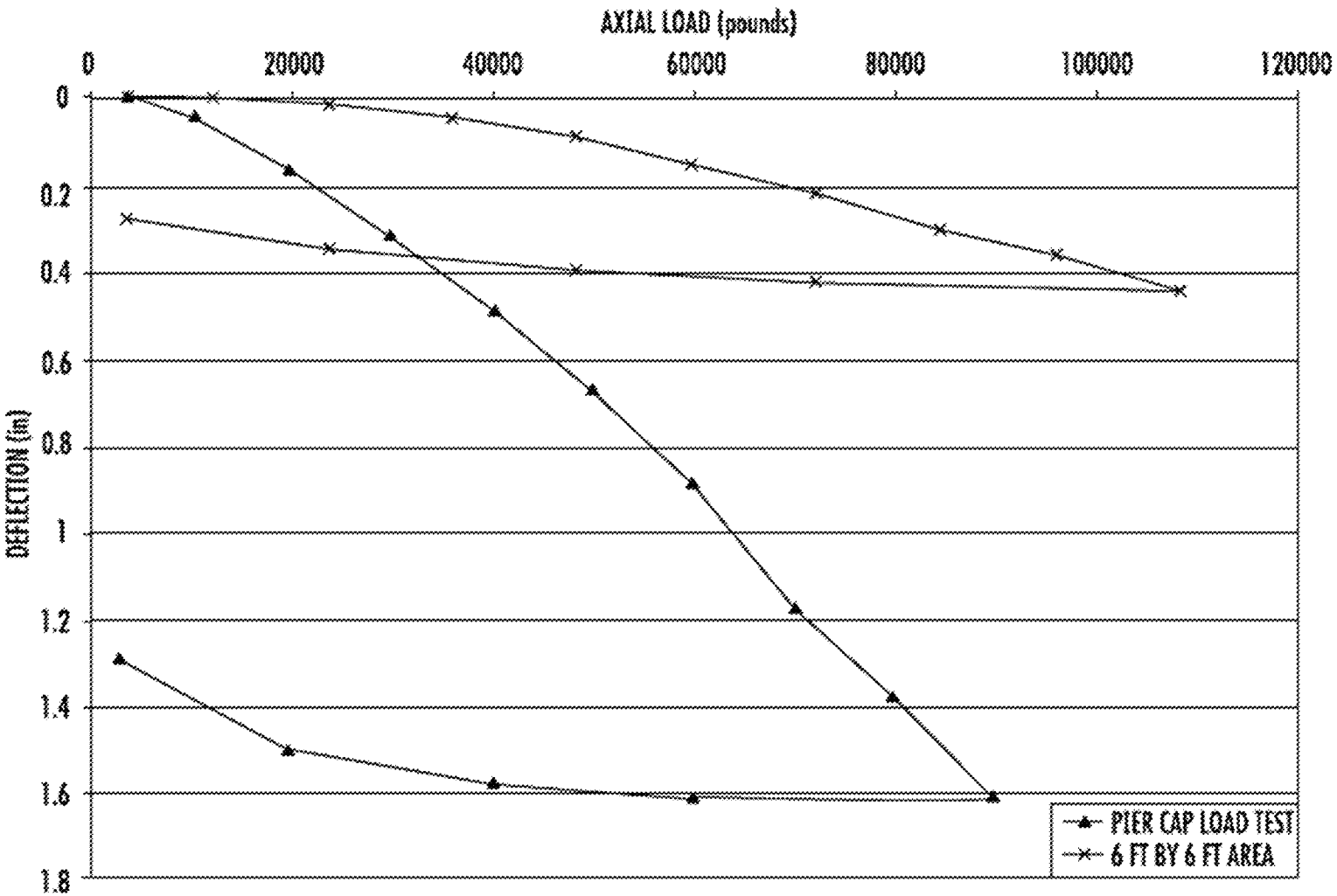

The shell piers were load tested using a hydraulic jack pushing against a test frame, with the results of the load testing being shown in FIG. 7. The shell pier tested with the 30 inch diameter concrete cap supported a load of 35,500 pounds (158 kN) at a deflection of 0.4 inches (10 mm). The shell pier tested with a 6 foot wide by 6 foot wide concrete cap supported a load of 104,700 pounds (467 kN) at a deflection of 0.4 inches (10 mm).

Slotted Shell Embodiment

Figure 8:
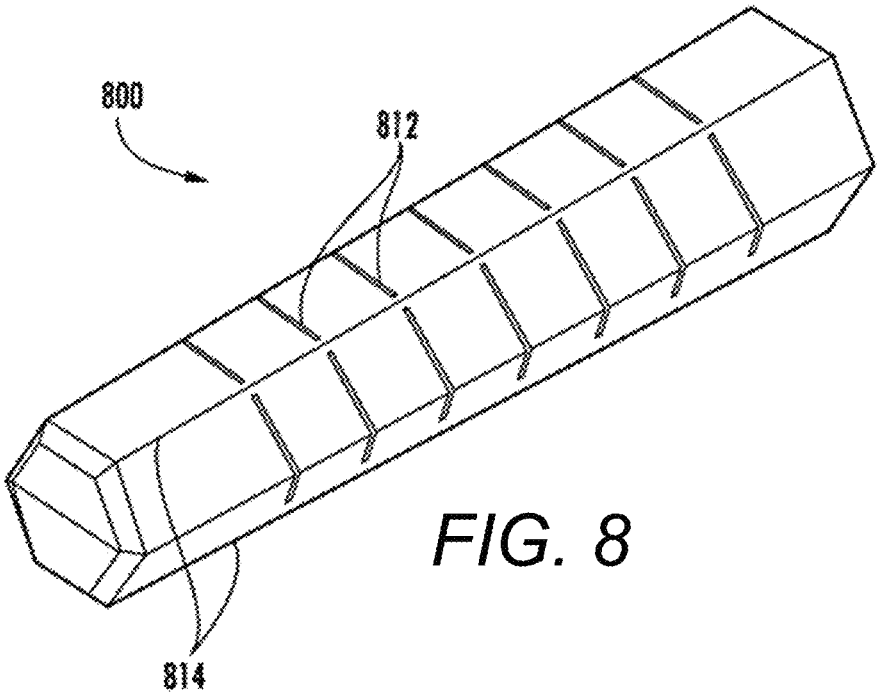
FIG. 8 illustrates a perspective view of another embodiment of the present invention pertaining to a slotted shell.

With reference to FIG. 8, an alternative embodiment of the present invention is shown and which includes an extensible shell 800 with one or more slits or slots 812 that extend between an interior of the shell to an exterior of the shell. The slots 812 may be placed over the entire length of the shell 800 or only partially located along the length and have varying spacing, such as, for example, slots being spaced every 6 inches (152 mm) starting generally 1.5 foot (0.46 m) from the top and bottom. The slots 812 may be of varying widths, such as, for example, ¼ inch (6.35 mm) to ⅜ inch (9.53 mm) wide. The slots 812 typically run generally transverse to a centerline along the length of the shell and may form a minor or major part of the circumference of the shell 800. In one embodiment, such as shown in FIG. 8, the slots 812 are discontinuous around the circumference leaving three spines 814 to maintain portions of continuous material connectivity along the length of the shell 800. The shell 800 of this embodiment may be of any suitable size or shape as described above with reference to shell 100.

As an example, a slotted extensible shell of this embodiment was installed at a test site in Iowa to compare the load versus deflection characteristics of this embodiment of the extensible shell to aggregate piers constructed using a driven tapered pipe. The test site was characterized by soft clay soil and the two comparison aggregate piers (of fine and coarse aggregate) were constructed to a depth of 12 feet below the ground surface.

For this test of the extensible shell, the shell was formed from High Density Polyethylene polymer and was formed by the rotomolding process. The shell formed a tapered shape that was hexagonal in cross section and tapered downward from an outside diameter of 23 inches (585 mm) at the top of the shell to a diameter of 18 inches (460 mm) at the bottom of the shell. The bottom of this embodiment of the extensible shell was integrally constructed as part of the shell walls as a result of the rotomolding process. In this embodiment of the invention (similar to that shown in FIG. 8), ¼ inch (6.35 mm) wide slots were cut in a circumferential orientation around the extensible shell. The extensible shell was left as a single continuous piece, by not removing material from three of the six corners or spines. The extractable mandrel used in this test was attached to a high frequency hammer, which is often associated with driving sheet piles. The hammer is capable of providing both downward force and vibratory energy for driving the shell into the ground and for compacting aggregate construction material in the shell.

In this example, the installation process included a 30 inch (0.76 m) diameter pre-drill to a depth of 1.5 feet (0.46 m) below the ground surface. The shell was then placed vertically in the pre-drilled hole and then the shell was driven with an extractable mandrel with exterior dimensions similar to those of the interior of the shell. The shell was driven to a depth of 11 feet (3.4 m) below grade. The mandrel was removed and the extensible shell was then filled with aggregate in four lifts; with each lift about 7.4 cubic feet (0.2 cubic meters) in volume. Each lift was compacted with the downward pressure and vibratory energy of the extractable mandrel.

After placement and compaction of aggregate within the extensible shell, the top of the shell was situated at about 1.5 feet (0.46 m) below the ground surface. The aggregate backfill was then leveled with the top of the shell, and a concrete cap was then poured above the shell to facilitate load testing.

Figure 9:
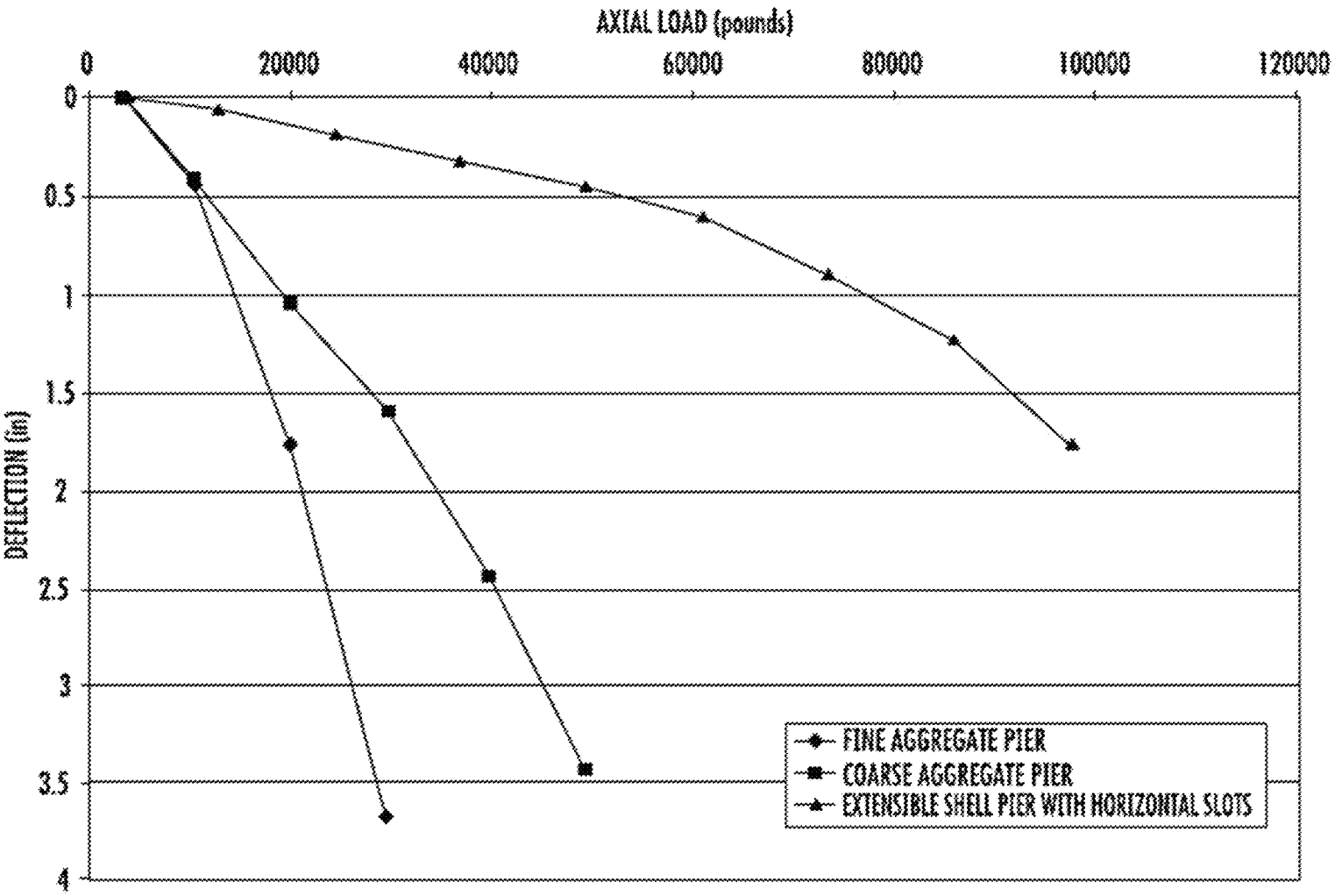
FIG. 9 is a graph showing results of load tests of a support pier constructed using an embodiment as shown in FIG. 8.

The slotted shell pier was load tested using a hydraulic jack pushing against a test frame. FIG. 9 is a graph showing results of the load test compared with the aggregate piers described above. As shown in FIG. 9, at a top of pier deflection of one inch, the piers constructed without slotted shells supported a load of 15,000 pounds to 20,000 pounds (67 kN to 89 kN). The pier constructed in this embodiment of the invention supported a load of 77,500 pounds (345 kN) at a top of pier deflection of one inch. The load carrying capacity of the pier constructed in accordance with this embodiment of the invention provided a 3.9 to 5.2 fold improvement when compared to aggregate piers constructed without extensible shells.

Open-End Embodiment

Figure 10A:
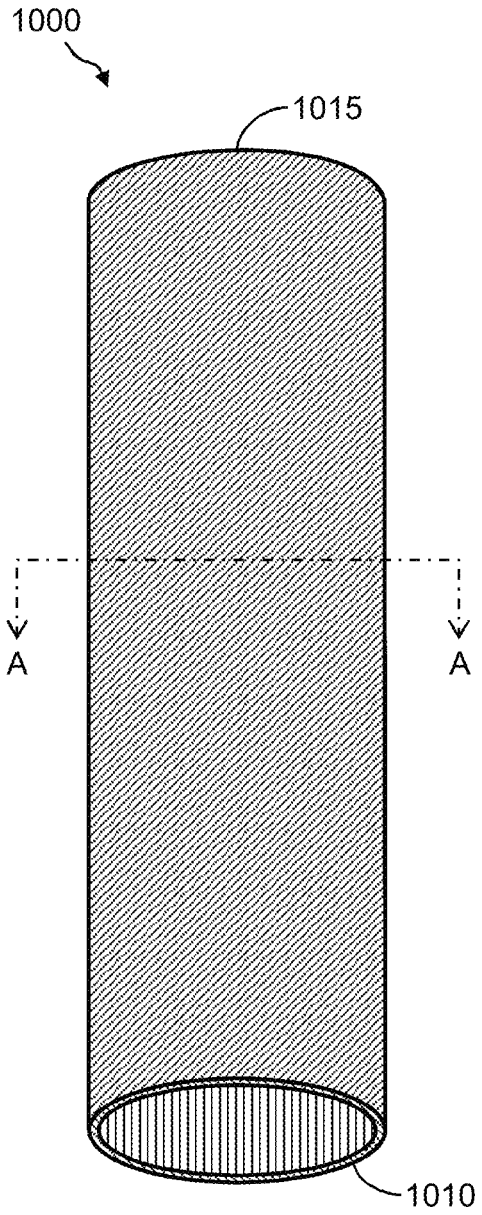
FIG. 10A and FIG. 10B illustrate a perspective view and a cross-sectional view of an example of an open-end extensible shell in accordance with embodiments of the present invention.

With reference to FIGS. 10A through 15B, an alternative embodiment of the present invention is shown and which includes an open-end extensible shell that can be used to form piers. Namely, FIG. 10A shows a perspective view of an example of an open-end extensible shell 1000. FIG. 10B shows a cross-sectional view of open-end extensible shell 1000 taken along line A-A for FIG. 10A. In this example, open-end extensible shell 1000 is a hollow tubular member that has a first open end 1010 and a second open end 1012. Open-end extensible shell 1000 can be used in any orientation with respect to driving into the ground. However, for illustration purposes, first open end 1010 is hereafter referred to as advancing open end 1010, wherein advancing open end 1010 means the bottom end of open-end extensible shell 1000 that is advanced into the ground first. Further, second open end 1012 is hereafter referred to as trailing open end 1012, wherein trailing open end 1012 means the top end of open-end extensible shell 1000 that is mated to driving equipment, such as a mandrel.

Open-end extensible shell 1000 can be any length and any width or diameter. Without limitation, the length of open-end extensible shell 1000 can be from about 3.05 m (5 feet) to about 6.1 m (20 feet) in one example, or can be about 3.05 m (10 feet) in another example. Without limitation, the width or diameter of open-end extensible shell 1000 can be from about 61 cm (24 in) to about 46 cm (18 in) in one example, or can be about 51.8 cm (20.4 in) in another example. In one example, open-end extensible shell 1000 can be formed of plastic, such as high-density polyethylene polymer (HDPE) plastic. In another example, open-end extensible shell 1000 can be formed of metal, such as steel or aluminum.

Figure 11A:
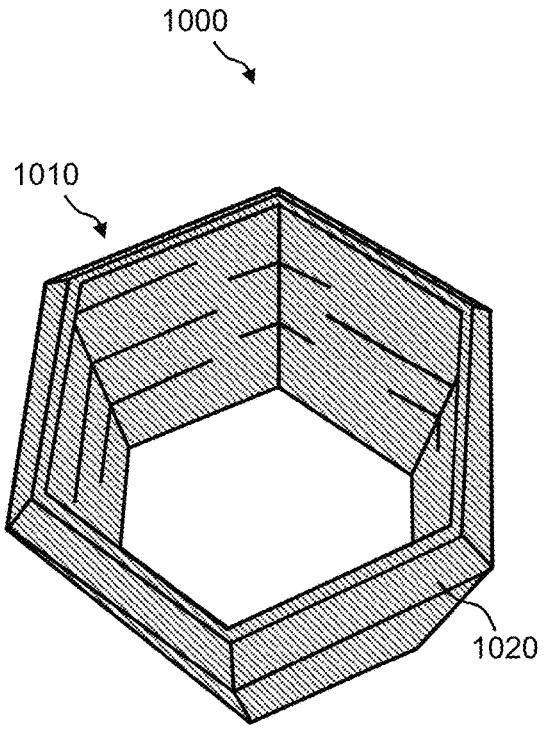
FIG. 11A, FIG. 11B, and FIG. 11C illustrate perspective views and a cross-sectional view of another example of an open-end extensible shell in accordance with embodiments of the present invention.
Figure 11B:
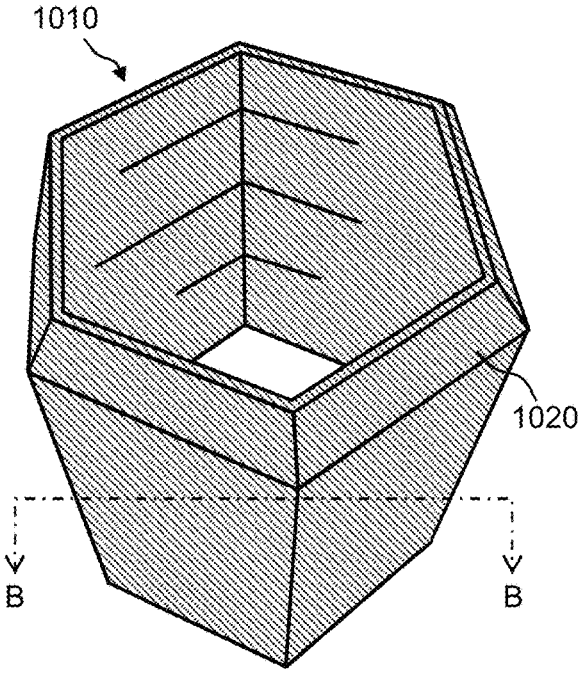
Figure 11C:
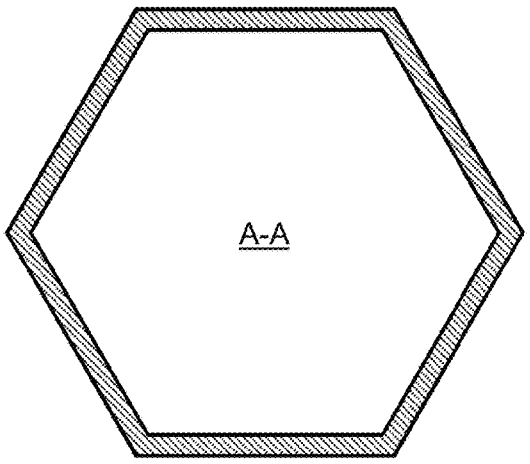

Open-end extensible shell 1000 is not limited to a straight tubular shape. For example, FIGS. 11A, 11B, and 11C illustrate various views of an example of an open-end extensible shell 100 that has a hexagon-shaped cross-section and a tapered tip; namely, advancing open end 1010 is tapered. Namely, FIGS. 11A and 11B show perspective views of the advancing open end 1010-portion of open-end extensible shell 100, which is hexagonal and includes a taper 1020. FIG. 11C shows a cross-sectional view of open-end extensible shell 1000 taken along line B-B for FIG. 11B. In one example, the width or diameter of open-end extensible shell 100 is tapered from about 51.8 cm (20.4 in) to about 46 cm (18.1 in).

Figure 12A:
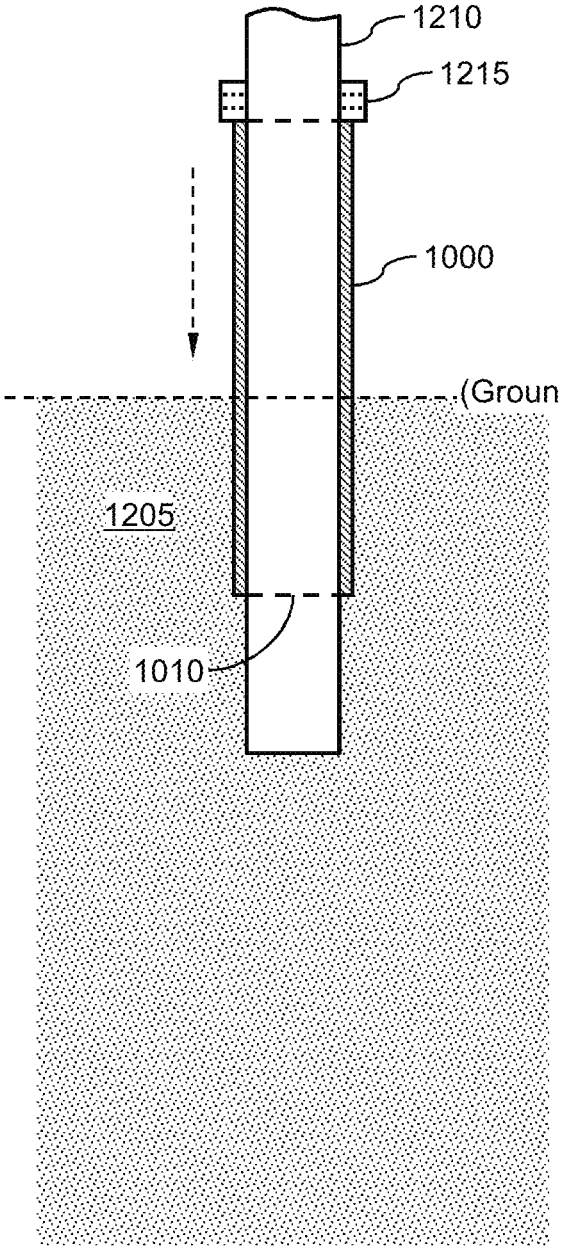
FIG. 12A and FIG. 12B show an example of a process of installing the open-end extensible shell into the ground.
Figure 12B:
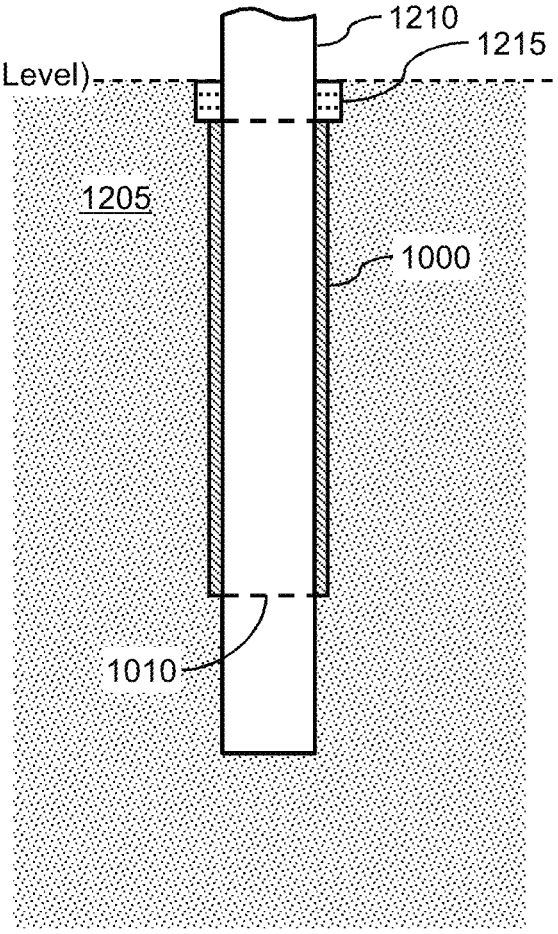

FIGS. 12A and 12B show an example of a process of installing open-end extensible shell 1000 into the ground (e.g., ground 1205). In this example, a closed pipe mandrel 1210 that has a shoulder collar 1215 is used to drive open-end extensible shell 1000 into ground 1205. Closed pipe mandrel 1210 is inserted into open-end extensible shell 1000 until shoulder collar 1215 contacts trailing open end 1012 of open-end extensible shell 1000. In this way, driving force is transferred from closed pipe mandrel 1210 to open-end extensible shell 1000. In FIGS. 12A and 12B, the advancing end of closed pipe mandrel 1210 extends beyond advancing open end 1010 of open-end extensible shell 1000. In one example, the end of closed pipe mandrel 1210 extends about 1.5 m (5 feet) beyond advancing open end 1010 of open-end extensible shell 1000.

Figure 13:
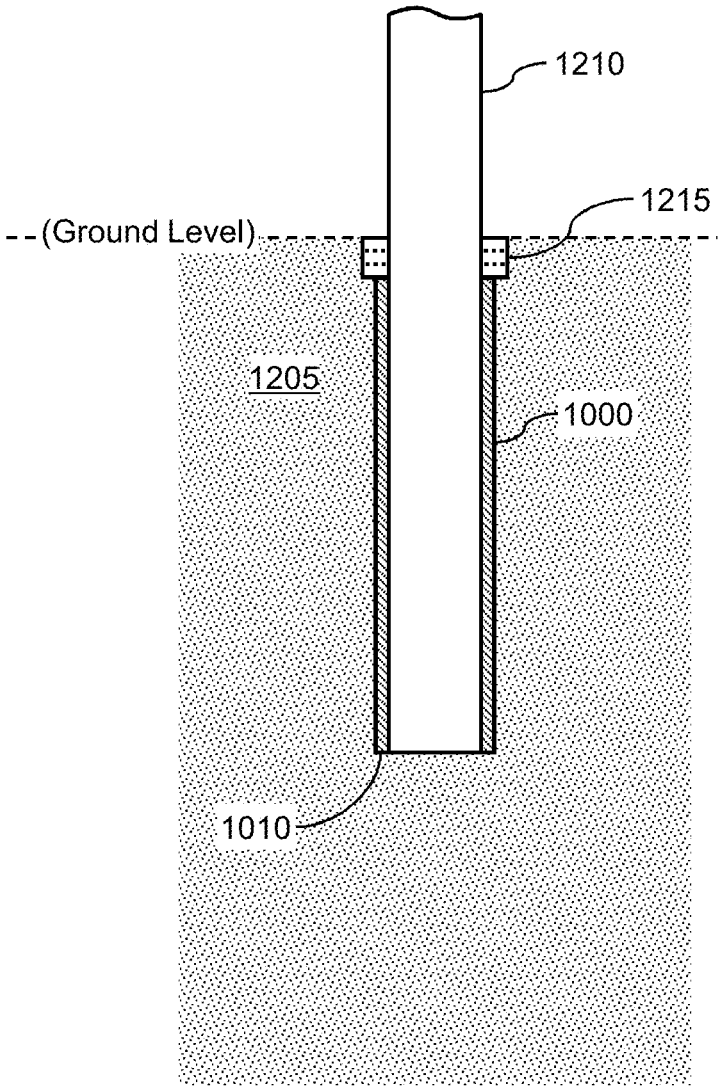
FIG. 13 shows another example of installing the open-end extensible shell into the ground.

However, the position of shoulder collar 1215 can be adjustable along the length of closed pipe mandrel 1210. Namely, shoulder collar 1215 can be adjustable such that a range of depths and relative positions of open-end extensible shell 1000 and closed pipe mandrel 1210 can be achieved without the need to change mandrels. For example, FIG. 13 shows the position of shoulder collar 1215 set such that the advancing end of closed pipe mandrel 1210 substantially aligns with advancing open end 1010 of open-end extensible shell 1000.

Figure 14:
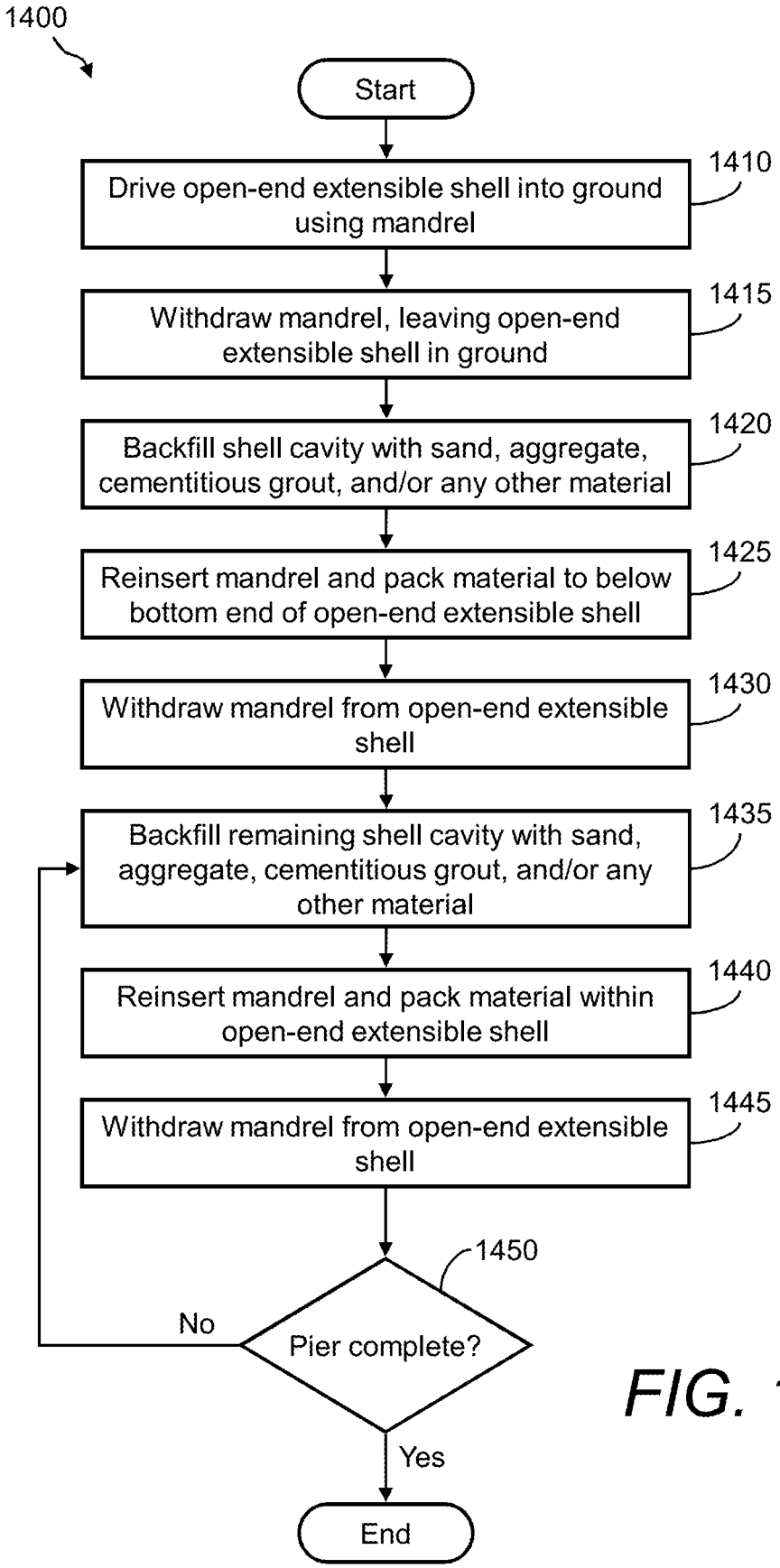
FIG. 14 shows a flow diagram of an example of a method of using the open-end extensible shell to form a support pier.

FIG. 14 shows a flow diagram of an example of a method 1400 of using open-end extensible shell 1000 to form a support pier. Method 1400 may include, but is not limited to, the following steps.

At a step 1410, open-end extensible shell 1000 is driven into the ground using a mandrel. For example and referring again to FIGS. 12A and 12B, open-end extensible shell 1000 is driven into ground 1205 using closed pipe mandrel 1210.

Figures 15A, 15B:
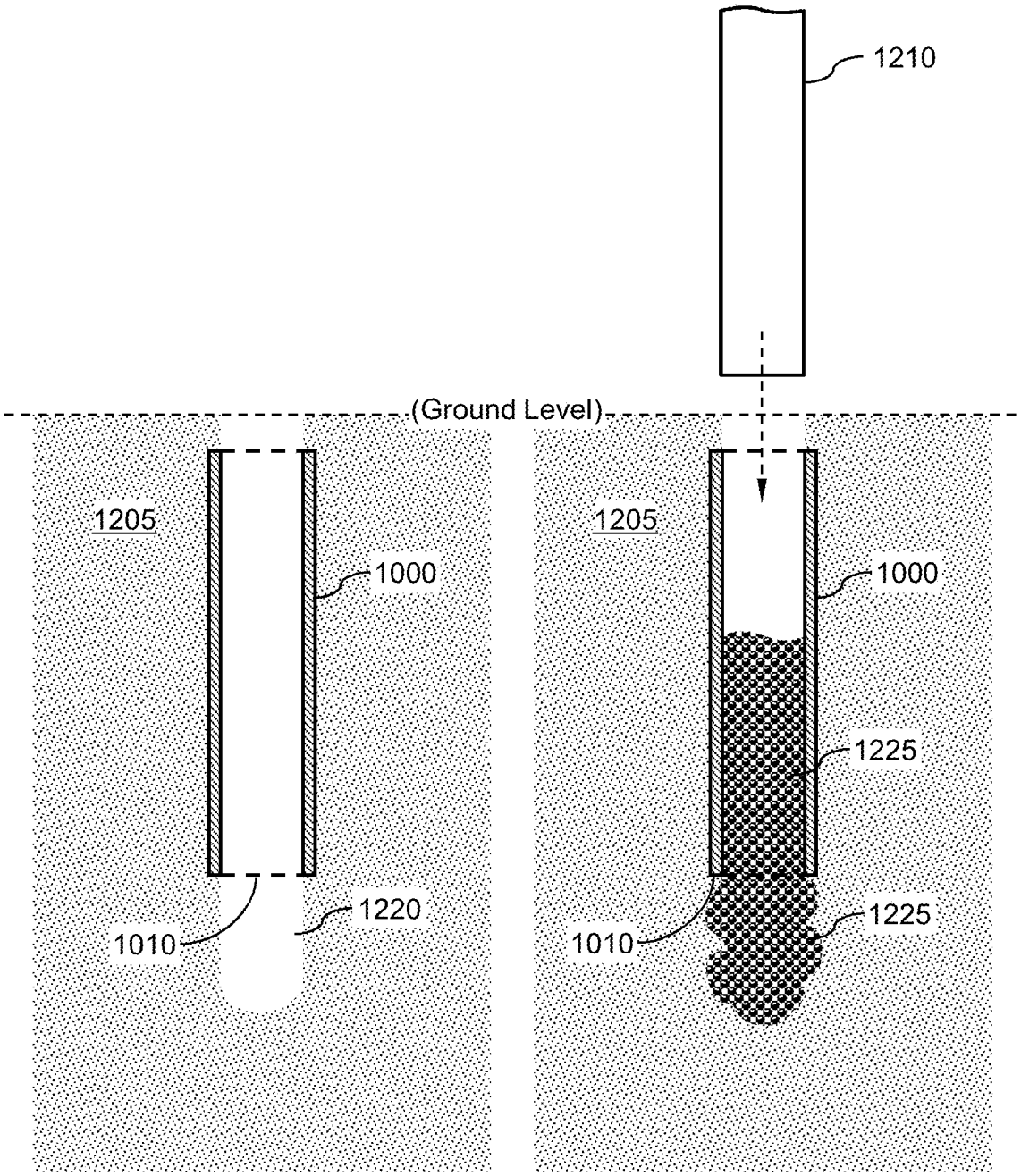
FIG. 15A and FIG. 15B show certain process steps of using the open-end extensible shell to form a pier.

At a step 1415, the mandrel (e.g., closed pipe mandrel 1210) is withdrawn from open-end extensible shell 1000, leaving open-end extensible shell 1000 in the ground. For example, FIG. 15A shows open-end extensible shell 1000 in ground 1205 after closed pipe mandrel 1210 is withdrawn, creating a shell cavity 1220. Namely, shell cavity 1220 is a portion of ground 1205 that is void of material.

At a step 1420, shell cavity 1220 is backfilled with sand, aggregate, cementitious grout, and/or any other material. For example, FIG. 15B shows shell cavity 1220 of open-end extensible shell 1000 backfilled with a volume of material 1225.

At a step 1425, the mandrel (e.g., closed pipe mandrel 1210) is reinserted into open-end extensible shell 1000. Then, material 1225 is packed to below advancing open end 1010 of open-end extensible shell 1000. For example, FIG. 15B shows a "bulb" of material 1225 is formed in ground 1205 below advancing open end 1010 of open-end extensible shell 1000.

At a step 1430, the mandrel (e.g., closed pipe mandrel 1210) is withdrawn from open-end extensible shell 1000, again as shown in FIG. 15A.

At a step 1435, the remaining portion of shell cavity 1220 is backfilled with material 1225 (e.g., sand, aggregate, cementitious grout, and/or any other material).

At a step 1440, the mandrel (e.g., closed pipe mandrel 1210) is reinserted into open-end extensible shell 1000. Then, material 1225 is packed into shell cavity 1220 of open-end extensible shell 1000.

At a step 1445, the mandrel (e.g., closed pipe mandrel 1210) is withdrawn from open-end extensible shell 1000, again as shown in FIG. 15A.

At a decision step 1450, it is determined whether the construction of the support pier is complete. If the construction of the support pier is complete, then method 1400 ends. However, if the construction of the support pier is not complete, then method 1400 returns to 1435.

A benefit of using open-end extensible shell 1000 and method 1400 is that it provides increased stiffness for the shell support layer and increased overall length of the extensible shell system in the upper zone (open-end extensible shell 1000 plus "bulb" depth).

Example V

As an example, support piers were constructed using extensible shells in accordance with embodiments of the present invention at a test site in Iowa. Load tests were conducted on the piers using a conventional process. The extensible shells used in the tests and the methods of their use consisted essentially of that described above and shown in FIGS. 10A through 15B. In this test, extensible shells formed of high-density polyethylene polymer (HDPE) plastic were installed at a test site characterized by soft clay soil. This testing was designed to compare the load versus deflection characteristics of an extensible shell in accordance with the present invention to aggregate piers constructed with a driven tapered pipe. Two comparison aggregate piers were constructed to a depth of 12 feet below the ground surface.

In this test, the extensible shell was formed by a roto-molding process. The shells defined a tapered shape having a hexagonal cross-section (e.g., as shown in FIGS. 11A, 11B, 11C) and that tapered downward from an outside diameter of 518 mm (20.4 inches) at the top of the shell to a diameter of 460 mm (18.1 inches) at the bottom of the shell. In this embodiment of the invention the extensible shell has a total length of 3.05 m (10 feet), and both the top and the bottom ends of the shell are open such that and extractable tapered mandrel commonly used for constructing aggregate piers could fully pass through the extensible shell.

The extractable mandrel used in this test was attached to a high frequency hammer, which is often associated with driving sheet piles. The hammer is capable of providing both downward force and vibratory energy for driving the shell into the ground and for compacting aggregate construction material in the shell. The "open bottom" extensible shell pier and the aggregate pier were constructed with a similar mandrel and high frequency hammer.

In this example, a 61 cm (24 in) diameter and 61 cm (24 in) deep pre-drill hole was formed at the ground surface prior to driving the extensible shell. The purpose of the pre-drill is to facilitate the placement of a concrete cap for the load test. The extensible shell, and Tapered Mandrel were then driven into the ground such that the tip of the tapered mandrel was at a depth of about 5.2 m (17 feet) below the ground surface, the bottom of the extensible shell was at a depth of about 3.65 m (12 feet) below the ground surface, and the top of the shell was at a depth of about 61 cm (24 in) below the ground surface.

The tapered mandrel used in this example is hollow such that such that the mandrel can be filled with aggregate, and allowed to flow out the bottom of the mandrel. An aggregate pier is constructed with this mandrel by raising and lowering the mandrel pre-determined distances to construct the aggregate pier. In this example, an aggregate pier was constructed below and within the extensible shell using a similar process.

Figure 10B:
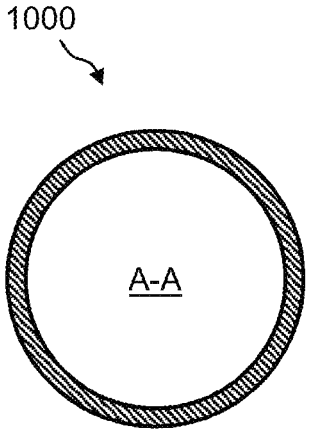
Figure 16:
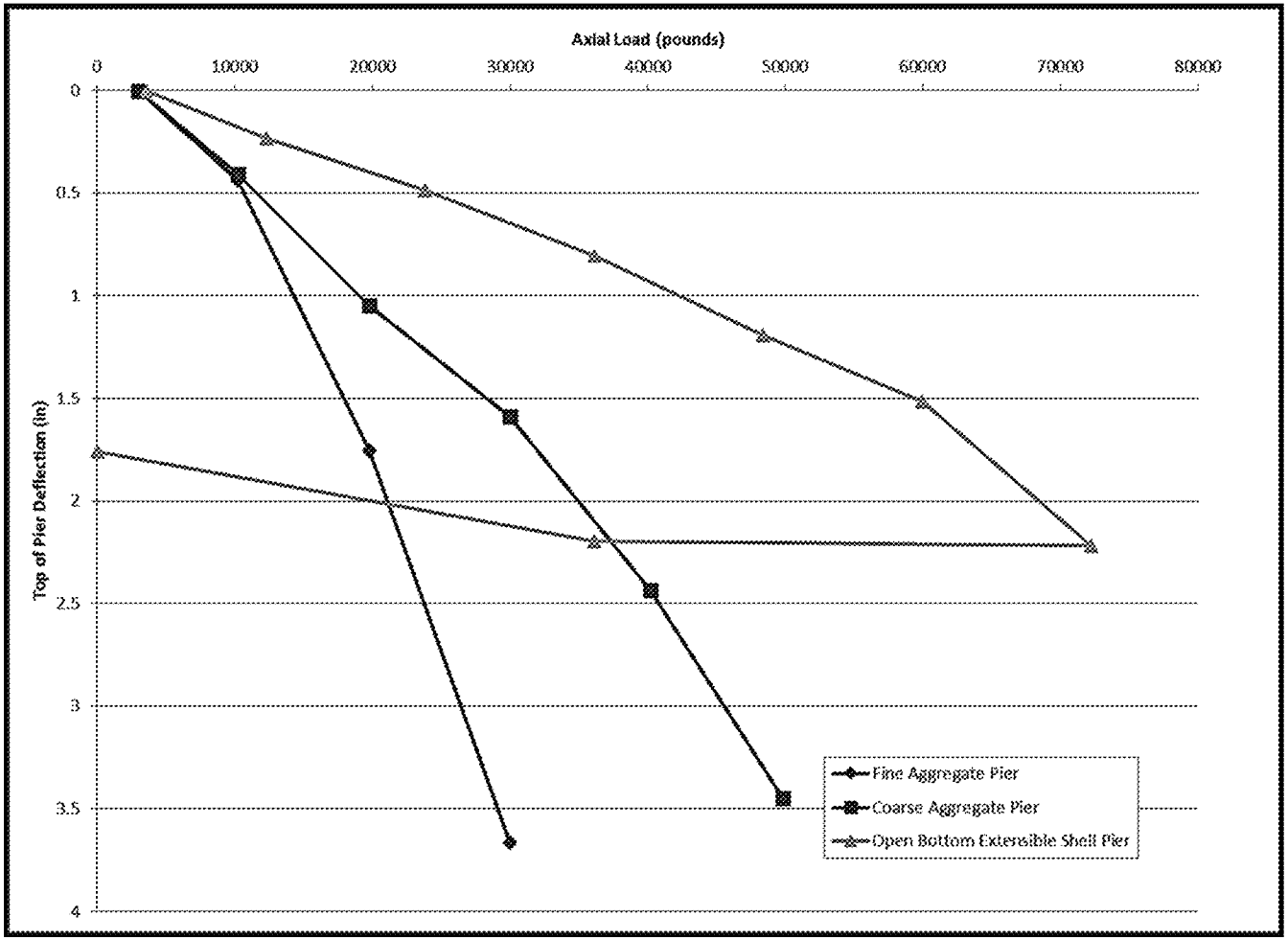
FIG. 16 is a graph showing results of load tests of a support pier constructed using an embodiment as shown in FIG. 10A, FIG. 10B and/or FIG. 11A, FIG. 11B, FIG. 11C.

The open bottom extensible shell piers were load tested using a hydraulic jack pushing against a test frame. FIG. 16 is a graph showing results of the load test compared with aggregate piers constructed using an embodiment as shown in FIGS. 10A, 10B and/or FIGS. 11A, 11B, 11C. As shown in FIG. 16, at a top of pier deflection of one inch, the piers constructed without shells supported a load of 67 kN to 89 kN (15,000 pounds to 20,000 pounds). The piers constructed in this embodiment of the invention supported a load of 188 kN (42,300 pounds) at a top of pier deflection of one inch. The load carrying capacity of the piers constructed in accordance with the present invention provided a 2.1 to 2.8 fold improvement when compared to aggregate piers constructed without extensible shells.

Ductile Pier Embodiment

Figure 17:
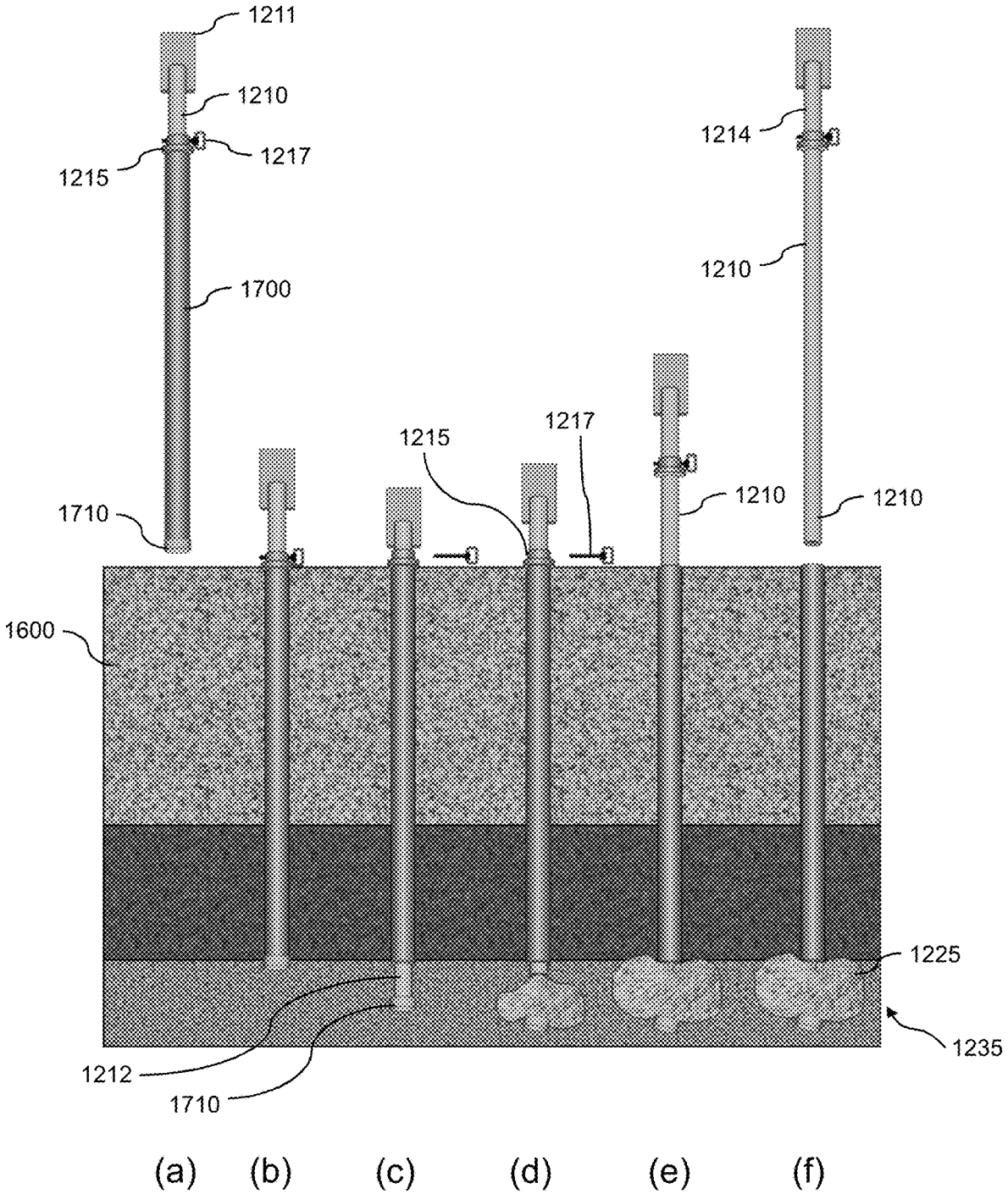
FIG. 17 show an example of a process of installing a closed-end extensible shell into the ground and forming a ductile pier.

With reference to FIG. 17, another embodiment of the present invention is shown and which includes a closed-end extensible shell 1700 that can be installed using an interior driving mandrel 1210 to form a pier. In this embodiment of the invention, the closed-end extensible shell 1700 typically includes a bottom cap 1710 that may be integral to the extensible shell 1700 or may be removable and affixed to the bottom of the extensible shell prior to driving. The driving mandrel 1210 is inserted into the closed-end extensible shell 1700 prior to driving. The driving mandrel 1210 typically includes a driving collar 1215 that rests on top of the closed-end extensible shell 1700 and is affixed to the driving mandrel 1210 using a threaded pin 1217 or other temporary attachment. The closed-end mandrel typically includes a driving plate 1211 that may be held in the jaws of a driving hammer (not shown). Alternative means of driving such as providing a bolt-on connector in lieu of the driving plate 1211 may also be used.

Once the mandrel 1210 is inserted into the closed end shell 1700 and the driving collar 1215 attached, then the mandrel is used to drive the closed-end extensible shell 1700 into the subsurface soil 1600. When the desired driving depth is reached, the driving hammer is arrested and the pin 1217 and driving collar 1215 is removed as shown in FIGS. 17*b* and 17*c*. The driving hammer is then used to continue to push and penetrate the mandrel 1210 downward without downward pressure exerted on the extensible shell 1700 by the driving collar 1215. As the mandrel 1210 is driven downward, the extensible shell 1700 is restrained from downward movement by the gripping action of the subsurface soil 1600. When the gripping resistance of the soil 1600 is greater than the strength of the connection between the extensible shell 1700 and the bottom cap 1710, the mandrel 1210 breaks through the bottom of the extensible shell 1700 and as shown in FIG. 17*c*. Filling material 1225, which may consist of crushed aggregate, sand, concrete, grout, or other flowable material, is then inserted into the mandrel 1210 to flow out flow ports that are provided in the mandrel bottom 1212.

As shown in FIGS. 17*d* and 17*e*, a bottom bulb 1235 then may be constructed below the bottom of the extensible shell 1700 to assist with load transfer to more competent bearing materials. The bottom bulb 1235 may be constructed using a pressurized mandrel delivery system or may be constructed via successive raising and lowering of the driving mandrel 1210. The pier is then constructed by raising the mandrel and simultaneously adding backfill materials to fill the extensible shell 1700 as shown in FIG. 17*f*.

A further embodiment of the present invention includes the ability to install the extensible shell 1700 in shortened modular sections. An extensible shell 1700, shortened to a minimum length, may be installed in similar fashion as described above to reinforce only a short section of the overall length of the pier. For example, a short section of the extensible shell 1700 may be installed just in the upper portion of the subsurface soil 1600 where lateral loads may be higher while a pier, unreinforced by an extensible shell, may be constructed to an arbitrary depth below. A second possible variation might include installing the short section of the extensible shell 1700 at only the mid-span of the overall pier while constructing and unreinforced pier to arbitrary elevations below and above.

One of the primary advantages of the use of an extensible shell in pier construction is the ability of the shell to extend and in turn bend and deform laterally during applications of lateral loads. The extensibility of the shell results from the relatively pliable elastic modulus values exhibited by the polymeric materials. This allows the shells to both function as extensible shells and also as ductile elements that may deform elasto-plastically without rupture. This allows the extensible shells to constrain the infill materials during many different combinations of load direction and intensity.

Example VI

The pier construction process described in FIG. 17 was used to construct concrete-filled ductile piers at a project site in New England. The site consisted of approximately 10 feet of medium stiff clay overlying bedrock. The closed-end extensible shells 1700 consisted of 6.625-inch outside diameter HDPE material with a sidewall thickness of 0.204 inches. The bottom foot 1710 was formed by making four 4-inch tall vertical cuts into the bottom of the extensible shell to form four lips at the bottom of the shell. The lips where then folded back and bolted together to form a bottom driving foot. A 5.5-inch outside-diameter steel driving mandrel was inserted into the shell and the driving collar 1215 was affixed to the driving mandrel using two pins that threaded through the collar to grab the side of the driving mandrel. The driving collar 1215 was then snugly pressed downward on the top of the extensible shell 1700. The mandrel 1210 was then used to drive the extensible shell 1700 into the ground 1600 to a depth of 8 feet. The driving collar 1215 was then loosened by removing the collar pins 1217 and the mandrel was driven through the bottom of the extensible shell foot 1710 to a depth of 10 feet. Sand-cement grout was then pumped using a displacement pump through a port at the top 1214 of the mandrel. The grout exhibited an unconfined compressive strength of 5300 pounds per square inch (psi) during a laboratory break strength test conducted 22 days after curing. The sand-cement grout exited the mandrel at the bottom 1212 of the mandrel and was used to form a bottom bulb 1235. The mandrel 1210 was then withdrawn from the extensible shell 1700 while the grout was pumped and placed within the shell 1700 during mandrel 1210 removal.

Figure 18:
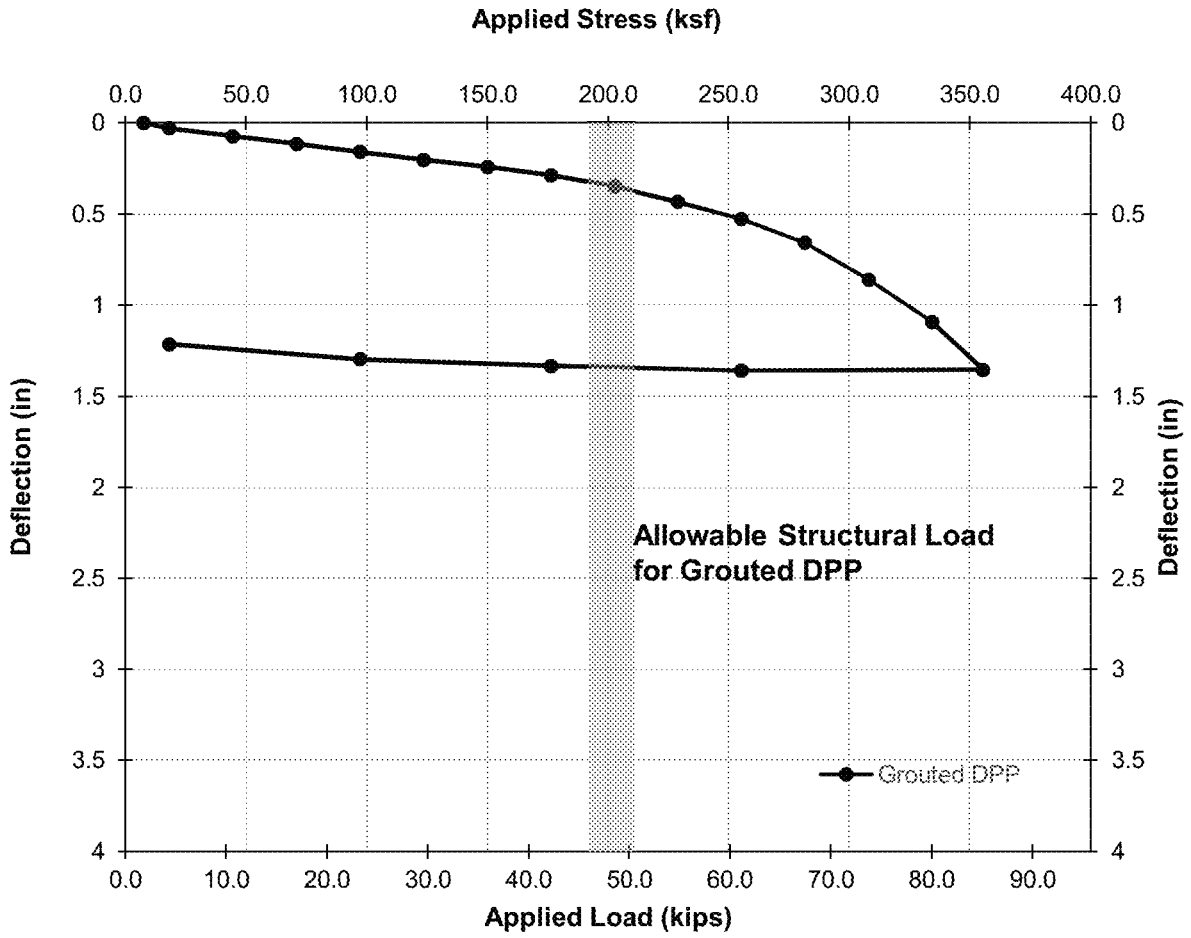
FIG. 18 is a graph showing results of load tests of an installed ductile pier constructed using an embodiment as shown in FIG. 17.

FIG. 18 shows the results of a cyclic load tests performed on an installed pier. The test was conducted by pushing downward on the installed pier using a 60-ton jack under the reaction of a 130,000 pound piling rig. FIG. 18 presents a plot of the stress applied to the top of the pier (ratio of the applied jack load to the pier cross-sectional area) vs. the measured downward deflection. An applied stress of 200 kips per square foot (ksf) corresponds to a design load that is 30% of the ultimate strength of the sand-cement grout. At an applied stress of 200 ksf, the measured deflection was 0.3 inches indicating very good performance. At an applied stress of 350 ksf, a measured pier deflection of 1.3 inches was noted. This deflection was interpreted to be the deflection of the bottom bulb materials pushing downward on the ground during load testing.

Figure 19:
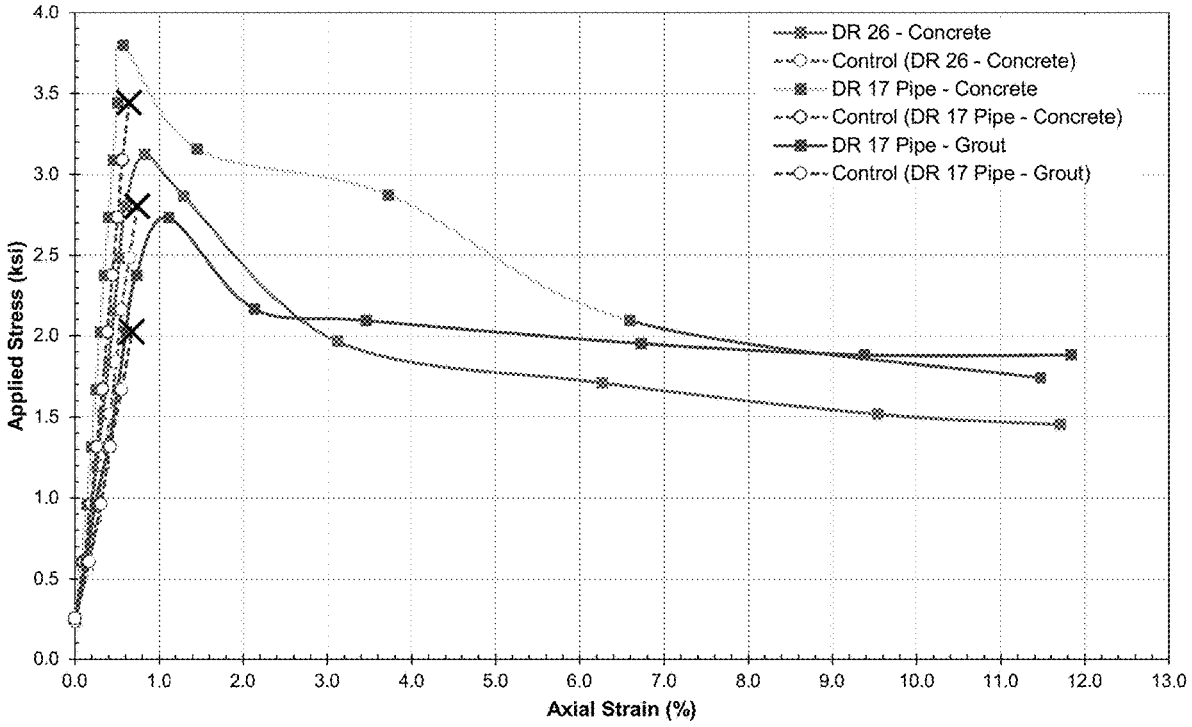
FIG. 19 is a graph showing results of load tests (ductile response) of concrete pier samples confined and unconfined by varying forms of extensible shells.

FIG. 19 shows the results of a series of field load tests made by obtaining 16-inch tall samples of concrete-filled extensible shell piers and testing the samples in unconfined compression. The samples were made by cutting 16-inch tall sections of 6.625-inch diameter extensible shells and filling the sample shells with concrete. The samples were then placed on a concrete pad and compressed downward by applying a load to the top of the samples using a 175-ton hydraulic jack applied to a field load test reaction frame. For the "control" samples, the shells were first cut vertically along their entire length so that they would be useful as a form for the placed concrete but would not have the ability to constrain the concrete during load testing. Shells with sidewall thickness values of 0.26 inches (DR26) and 0.4 inches (DR17) were both tested. The response of the samples tested with intact shells are shown in the solid lines; the response of the samples tested with the "control" (vertically cut) samples are shown by the dashed lines. For both sets of test, those conducted for DR26 and DR17 shells, the "control" samples reached a brittle response at a strain of less than 1% at their ultimate compressive strength values (3.4 kips per square inch (ksi) and 2.8 ksi for the DR17 and DR26 shells respectively). The ultimate strength of the intact shell samples were 3.8 ksi and 3.15 ksi for the DR17 and DR26 shells respectively, values about 12 percent higher than the control (unconfined) samples. Further and importantly, the response of the intact shell piers was ductile, meaning that the samples retained more than 50% of their peak strength at axial strains exceeding 10 percent. These results show the value of the extensible shells to provide a ductile response during load applications.

Figure 20:
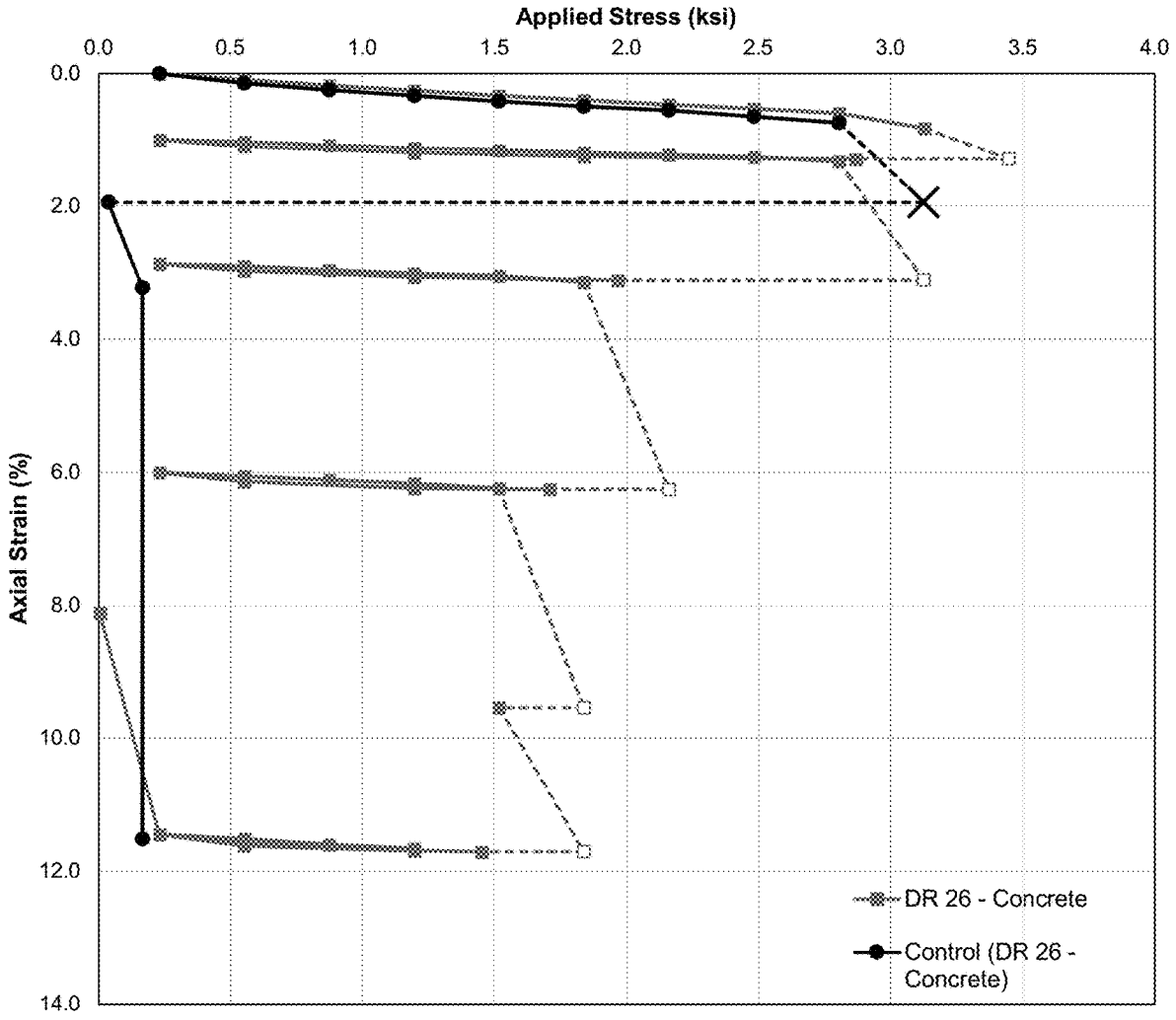
FIG. 20 is a graph showing results of load tests on the confined and unconfined concrete pier samples shown in FIG. 21.

FIG. 20 shows the results of one series of cyclic field load tests performed on 16-in tall, 0.26 inch-thick (DR26) concrete-filled extensible shell pier samples. The extensible shell in the "control" sample was cut and removed such that it could not constrain the concrete during loading. The samples were then placed on a concrete pad and compressed downward by applying a load to the top of the samples using a 175-ton hydraulic jack applied to a field load test reaction frame. The downward load was applied and released in a cyclic manner to measure the rebound capacity of the concrete-filled extensible shell pier sample. These tests were strain controlled meaning that the downward load was increased until a desired vertical strain was achieved. Once the desired vertical axial strain was achieved, the downward pressure was released and the sample was allowed to rebound. The response of the sample with the intact extensible shell is shown by the solid green line and the "control" sample with no extensible shell is shown by the solid black line. For both samples the dashed lines indicate the load portion at the end of the cycle where the applied vertical load was greater than the vertical capacity of the sample. In this portion, the samples underwent continuous axial strain until they were unloaded. A total of four load/unload cycles were applied to the intact sample to achieve vertical strains of approximately 1%, 3%, 6%, and 12%. The "control" sample reached a brittle response and was unable to sustain any substantial vertical load after the first cycle. The ultimate strength of the intact specimen was approximately 3.2 ksi at 1% strain which was about 12 percent higher than the control (unconfined) sample. At axial strains of approximately 3%, 6%, and 12%, the intake specimen yielded residual strengths of 2.0 ksi, 1.7 ksi, and 1.5 ksi, respectively. The slope of the unload/reload portions of the intact sample exhibited flat behavior indicating that the intact sample could sustain vertical load at stress levels less than the residual strength without incurring any substantial axial strain.

Figure 21:
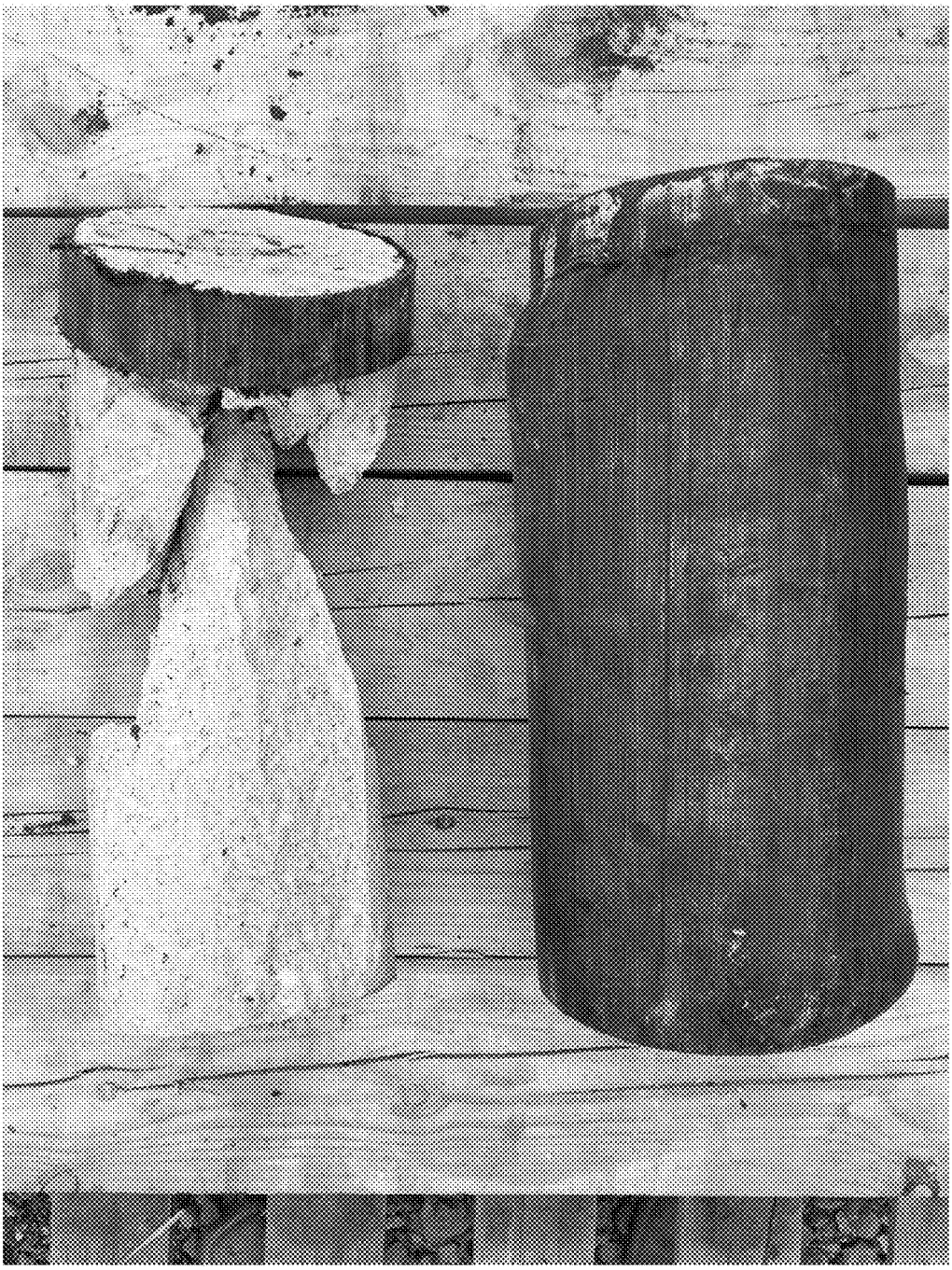
FIG. 21 is an illustration of the confined and unconfined samples used in the testing shown in FIG. 20.

FIG. 21 shows an illustration of the failed specimens described above. The specimen on the right shows the failed sample loaded with the intact extensible shell and the specimen on the left shows the failed sample loaded without the extensible shell. As can be seen, the concrete in the failed specimen on the right is retained by the extensible-shell. The shell shows signs of bulging and plastic deformation, but remains 100% intact to provide confinement to the concrete. The specimen on the left shows the concrete in a completely fractured state. The fractured concrete in the specimen was not retained by the means of the extensible shell and therefore results in poorer vertical load test performance in comparison to the sample confined by the extensible shell on the right.

The foregoing detailed description of embodiments refers to the accompanying drawings, which illustrate specific embodiments of the invention. Other embodiments having different structures and operations do not depart from the scope of the invention. The term "the invention" or the like is used with reference to certain specific examples of the many alternative aspects or embodiments of the applicant's invention set forth in this specification, and neither its use not its absence is intended to limit the scope of the applicant's invention or the scope of the claims. Moreover, although the term "step" may be used herein to connote different aspects of methods employed, the term should not be interpreted as implying any particular order among or between various steps herein disclosed unless and except when the order of individual steps is explicitly described. This specification is divided into sections for the convenience of the reader only. Headings should not be construed as limiting of the scope of the invention. It will be understood that various details of the invention may be changed without departing from the scope of the invention. Furthermore, the foregoing description is for the purpose of illustration only, and not for the purpose of limitation.

What is claimed:

1. A system for installing ductile support piers in ground, the system comprising:

an extensible shell defining an interior for holding granular construction material and defining a first end having a first opening therethrough for receiving the granular construction material into the interior and an opposing second end having an end closed by a removable cap;

a driving mandrel for nesting in to the extensible shell, the driving mandrel further comprising a removable driving collar for using in driving the nested extensible shell, and a removable pin, wherein the removable cap is configured with a first connection configuration for driving, such that the removable cap is securely connected to the extensible shell, and a second connection configuration such that when the gripping resistance of the ground is greater than the strength of the first connection configuration, the removable cap is breakable off of the extensible shell by the driving mandrel.

2. The system of claim 1, wherein the pin is threaded.

3. The system of claim 1, wherein the driving collar rests on top of the extensible shell.

4. The system of claim 1, wherein the driving mandrel includes a driving plate.

5. The system of claim 1, wherein the driving mandrel includes a bolt-on connector.

6. The system of claim 1, wherein the extensible shell is constructed of modular sections.

7. A method for constructing a ductile support pier in ground, the method comprising:

positioning an extensible shell for driving into ground, the shell defining an interior for holding granular construction material and defining a first end having a first opening therethrough for receiving the granular construction material into the interior and an opposing second end having an end closed by a removable cap, wherein the removable cap is configured with a first connection configuration for driving, such that the removable cap is securely connected to the extensible shell, and a second connection configuration such that when the gripping resistance of the ground is greater than the strength of the first connection configuration, the removable cap is removable from the extensible shell by the driving mandrel;

inserting a driving mandrel into the shell, the driving mandrel further comprising a removable driving collar for using in driving the nested extensible shell, and a removable pin;

driving the shell with the removable cap in the first connection configuration into the ground using the driving mandrel to a desired driving depth;

removing the driving collar and continuing to drive the mandrel with the removable cap in the second connection configuration, such that the cap is removed;

filling the shell with granular construction material;

compacting the granular construction material such that a bottom bulb is formed beneath the shell as driven into the ground and the desired driving depth;

raising the mandrel out of the shell while simultaneously adding additional granular construction material to fill the shell and form a ductile pier.

8. The method according to claim 7, further comprising installing the extensible shell in modular sections.

* * * * *